US006659783B2

(12) United States Patent
Copper et al.

(10) Patent No.: US 6,659,783 B2
(45) Date of Patent: Dec. 9, 2003

(54) ELECTRICAL CONNECTOR INCLUDING VARIABLE RESISTANCE TO REDUCE ARCING

(75) Inventors: Charles Dudley Copper, Harrisburg, PA (US); Henry O. Herrmann, Jr., Elizabethtown, PA (US); Randy Thomas Matthews, Yadkinville, NC (US); Larry George Novotny, Clemmons, NC (US); Jeremy Patterson, McLeansville, NC (US); Norbert Krause, Bensheim (DE); Horst Teutschlaender, Heppenheim (DE)

(73) Assignee: Tyco Electronics Corp, Middletown, PA (US)

( * ) Notice: Subject to any disclaimer, the term of this patent is extended or adjusted under 35 U.S.C. 154(b) by 0 days.

(21) Appl. No.: 10/022,635

(22) Filed: Dec. 17, 2001

(65) Prior Publication Data

US 2003/0027447 A1 Feb. 6, 2003

Related U.S. Application Data

(60) Provisional application No. 60/309,424, filed on Aug. 1, 2001, and provisional application No. 60/324,111, filed on Sep. 21, 2001.

(51) Int. Cl.[7] ..... H01R 13/53

(52) U.S. Cl. ..... 439/181; 439/157; 439/839; 361/2

(58) Field of Search ..... 439/181, 620, 439/924.1, 157, 358, 520, 187; 361/106, 58, 2, 8, 9, 10, 11; 218/65

(56) References Cited

U.S. PATENT DOCUMENTS

| | | | | |
|---|---|---|---|---|
| 3,488,761 A | | 1/1970 | Toshio Ito et al. | |
| 3,956,723 A | | 5/1976 | Dickens et al. | |
| 4,070,641 A | | 1/1978 | Khalid | |
| 4,079,440 A | * | 3/1978 | Ohnuma et al. | 361/58 |
| 4,178,618 A | | 12/1979 | Khalid | |
| 4,198,024 A | * | 4/1980 | Cavanna | |
| 4,438,472 A | | 3/1984 | Woodworth | |

(List continued on next page.)

FOREIGN PATENT DOCUMENTS

| | | | |
|---|---|---|---|
| EP | 0 517 618 B1 | | 4/1995 |
| EP | 0 507 517 B1 | | 5/1995 |
| JP | 3-20978 | * | 1/1991 |

OTHER PUBLICATIONS

IBM Technical Disclosure, vol. 25, No. 1 p. 405, Jun. 1982.*

Resistance Recovery of VTP Devices after a Trip Event, Lam, Johnny, Raychem Corporation, 1999.

PolySwitch Telecom and Network Resettable Fuses, Tyco Electronics Coporation, 2000.

*Primary Examiner*—Neil Abrams

(57) ABSTRACT

Electrical connectors (40, 104) including contact terminals that can be unmated without previously disconnecting power include main contacts (12, 112) and auxiliary contacts (16, 130) that are shunted by a positive temperature coefficient (PTC) resistor (6, 140) located between the main and auxiliary contact. The main contact (12, 112) will be disconnected first and the auxiliary contact (16, 130) can be longer than the main contact (12, 112). Arcing will not occur at the mating end of the main contact (12, 112), because the current will be shunted to the still connected longer auxiliary contact (16, 130). $I^2R$ heating will increase the resistance in the PTC resistor (6, 140), so when the auxiliary contact (16, 130) is disconnected, current will be below the arcing threshold. Multiple latches (54A,B) and (60A,B) or (180) and (196) permit only discontinuous mating and unmating or two state mating and unmating of electrical connectors, so that the connectors can be disconnected without arcing for a range of currents.

41 Claims, 20 Drawing Sheets

U.S. PATENT DOCUMENTS

| | | | | | |
|---|---|---|---|---|---|
| 4,583,146 | A | | 4/1986 | Howell | |
| 4,659,160 | A | * | 4/1987 | Jonval | 439/187 |
| 4,681,549 | A | * | 7/1987 | Peterson | 439/181 |
| 4,816,958 | A | | 3/1989 | Belbel et al. | |
| 4,821,014 | A | * | 4/1989 | Masuda | |
| 5,049,850 | A | | 9/1991 | Evans | 338/22 R |
| 5,176,528 | A | | 1/1993 | Fry et al. | |
| 5,178,797 | A | | 1/1993 | Evans | 252/508 |
| 5,247,277 | A | * | 9/1993 | Fang | |
| 5,378,407 | A | | 1/1995 | Chandler et al. | |
| 5,428,195 | A | | 6/1995 | Arnold | |
| 5,495,083 | A | * | 2/1996 | Aymami-Pala et al. | 218/1 |
| 5,629,658 | A | | 5/1997 | Chen | |
| 5,645,746 | A | | 7/1997 | Walsh | |
| 5,689,395 | A | | 11/1997 | Duffy et al. | |
| 5,737,160 | A | | 4/1998 | Duffy | |
| 5,777,286 | A | * | 7/1998 | Abot et al. | 361/8 |
| 5,864,458 | A | | 1/1999 | Duffy et al. | |
| 5,909,065 | A | * | 6/1999 | Jones et al. | 307/147 |
| 5,945,903 | A | | 8/1999 | Reddy et al. | |
| 5,983,298 | A | | 11/1999 | Schultz et al. | |
| 6,072,673 | A | * | 6/2000 | Chen et al. | 361/9 |
| 6,072,680 | A | | 6/2000 | Goodwin et al. | |
| 6,078,160 | A | | 6/2000 | Cilluffo | |
| 6,217,356 | B1 | | 4/2001 | Davis et al. | |

* cited by examiner

FIG 3A
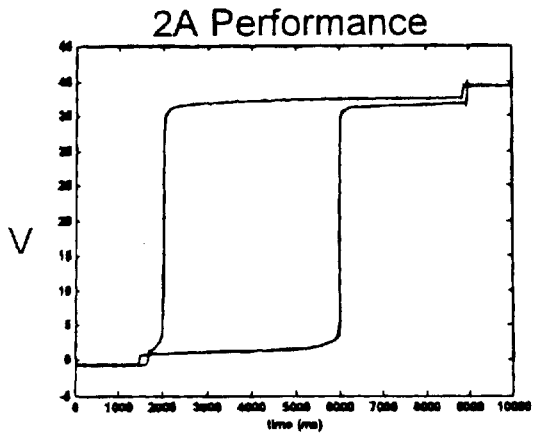
FIG 3B
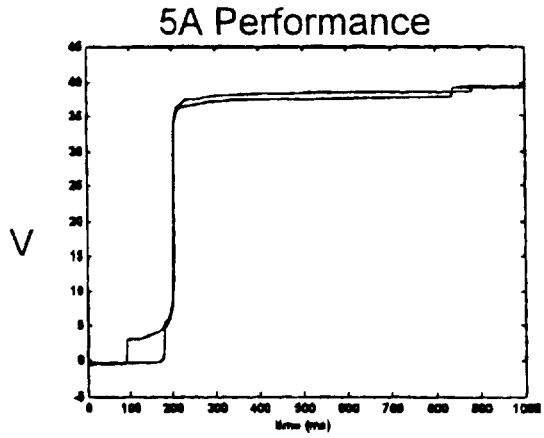
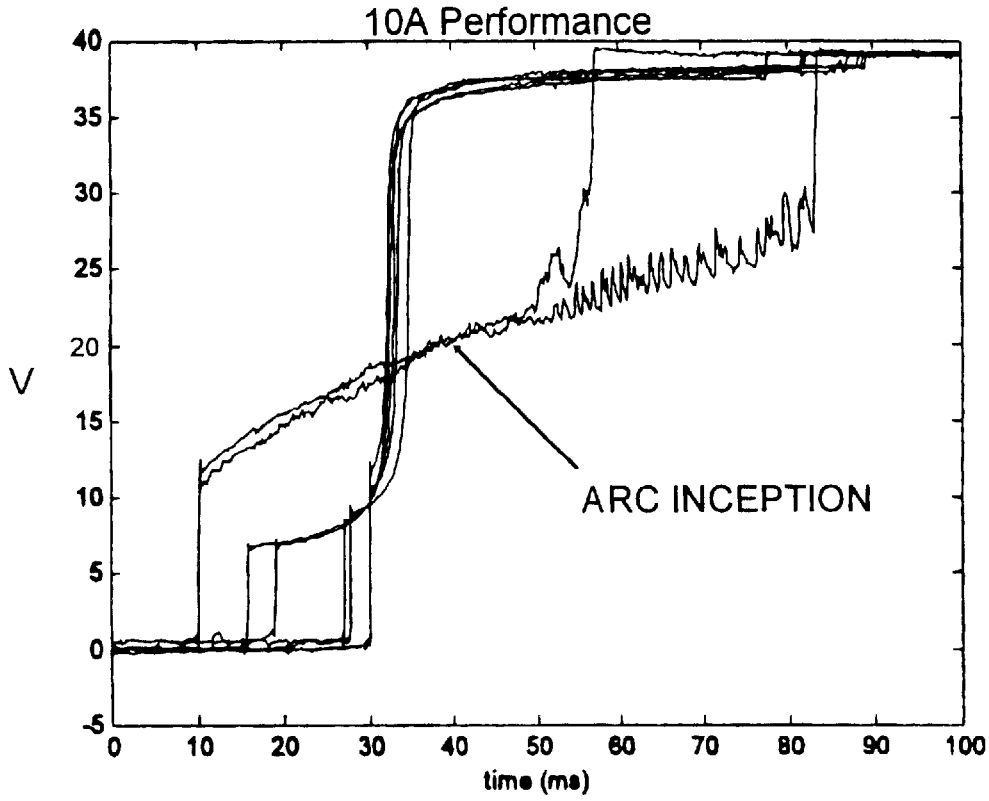
FIG 3C

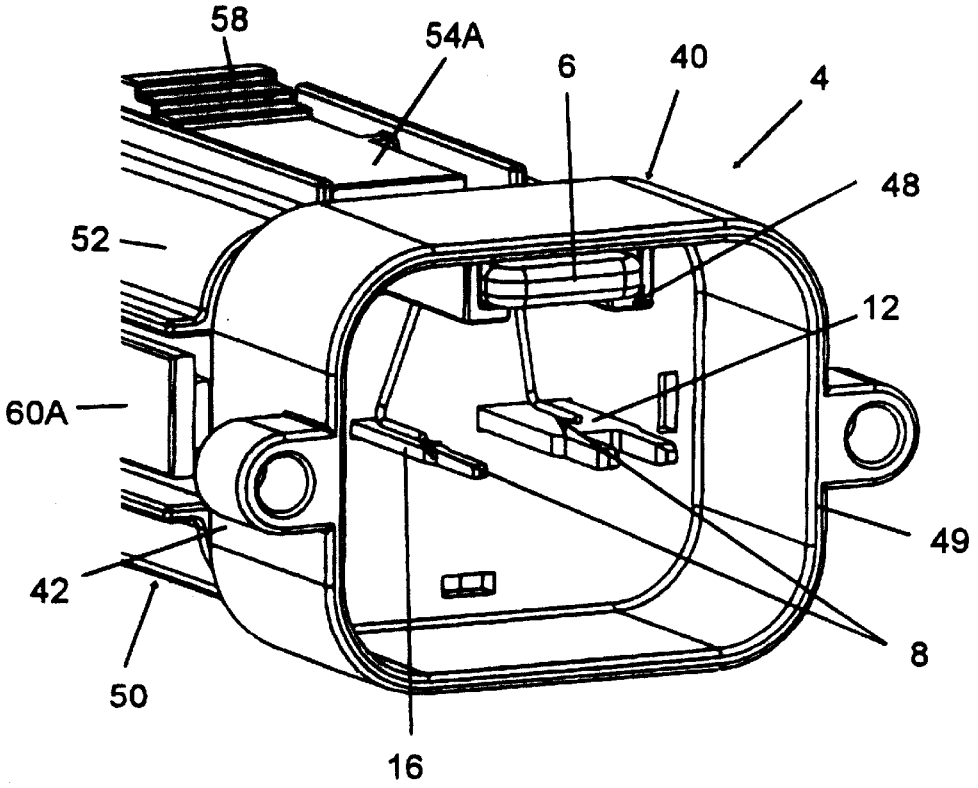
FIG 5
FIG 6
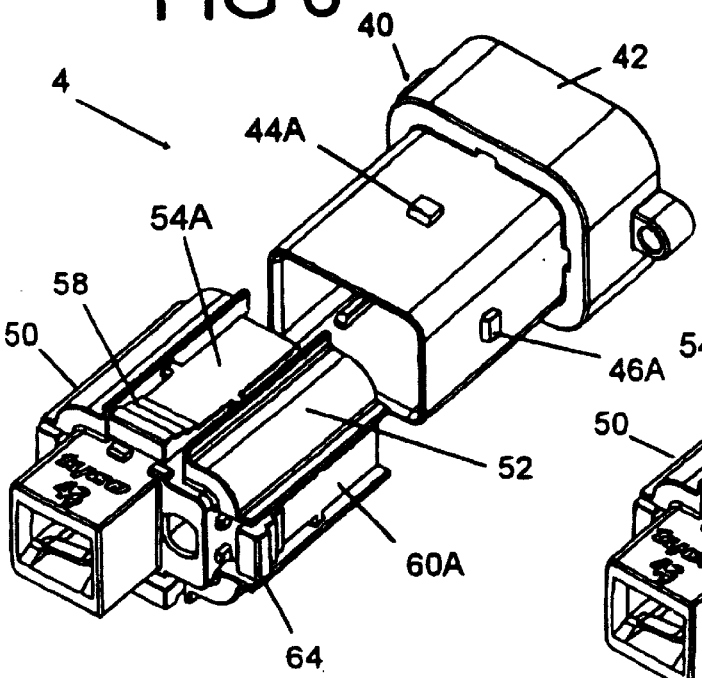
FIG 7
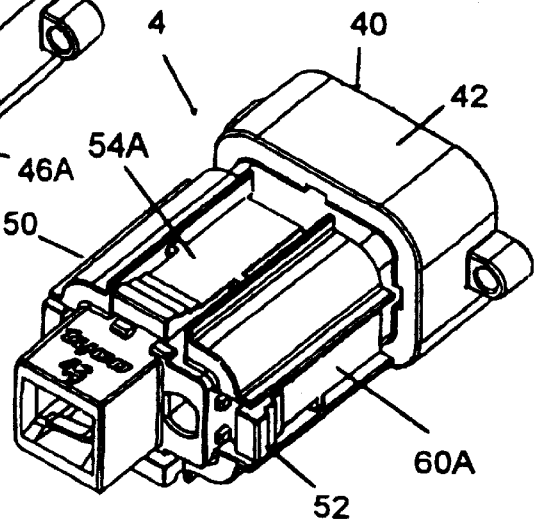

FIG 23
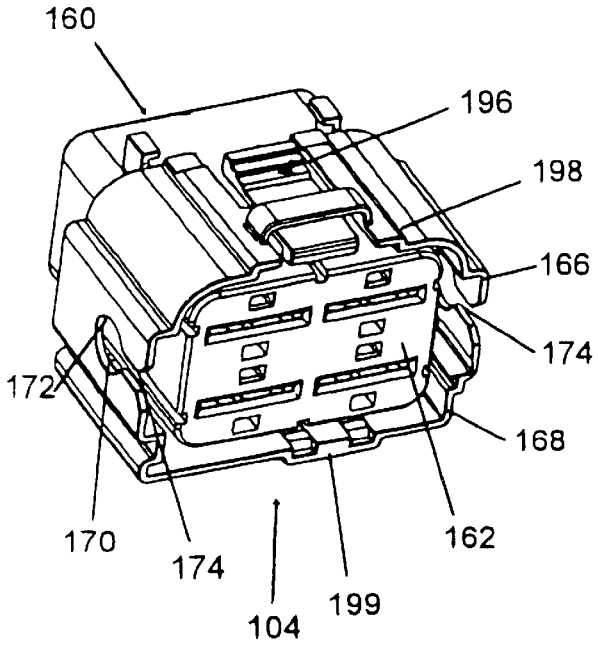
FIG 24
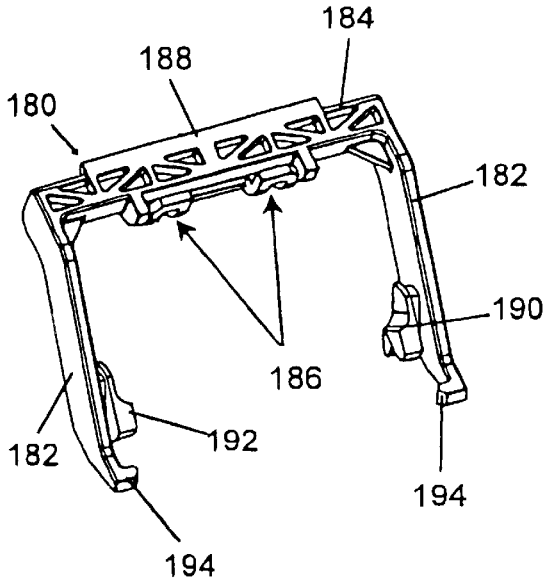
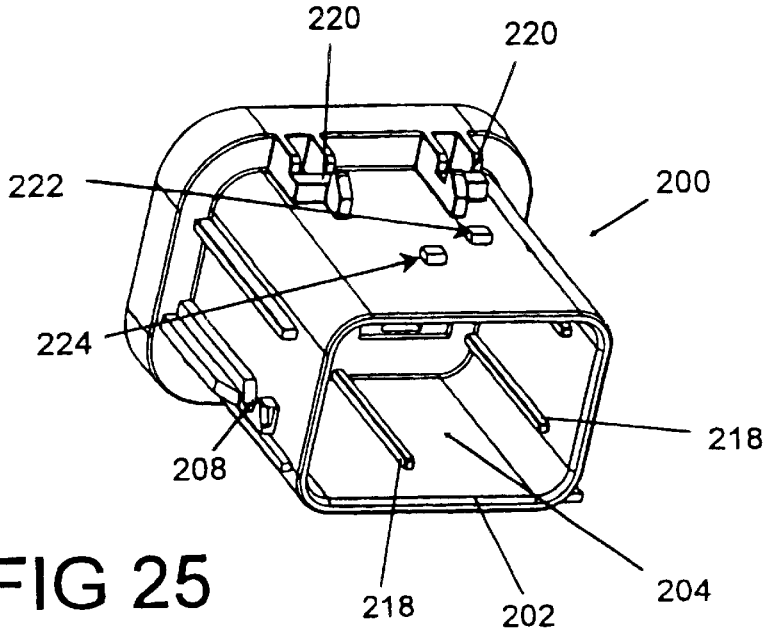
FIG 25

FIG 38
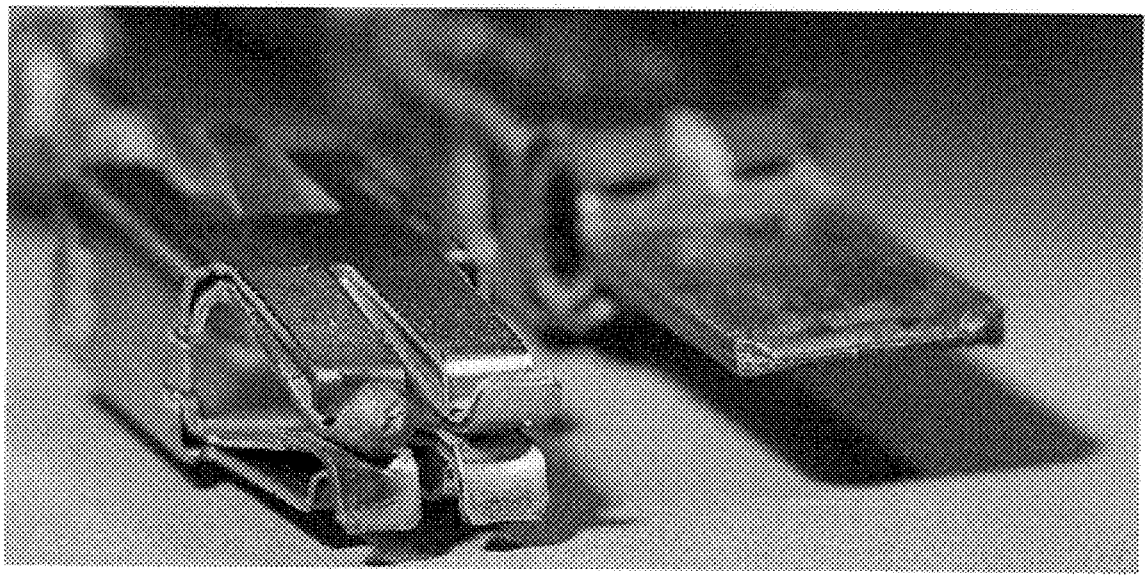
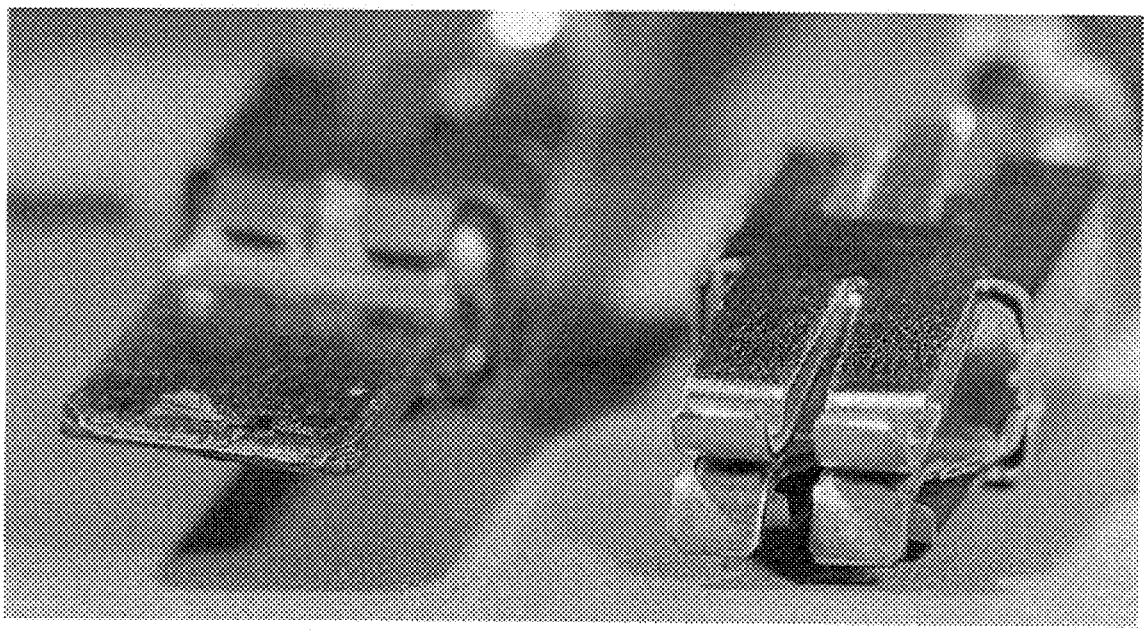
FIG 39

ELECTRICAL CONNECTOR INCLUDING VARIABLE RESISTANCE TO REDUCE ARCING

CROSS REFERENCE TO PRIOR CO-PENDING PATENT APPLICATIONS

This application claims the benefit of Provisional Patent Application Serial No. 60/309,424 filed Aug. 1, 2001 and of Provisional Patent Application Serial No. 60/324,111 filed Sep. 21, 2001.

BACKGROUND OF THE INVENTION

1. Field of the Invention

This invention relates to an electrical connector including means for preventing or suppressing an arc when power contacts are disconnected or separated while they carry substantial power or electrical current. This invention also relates to an electrical connector that preferentially uses a positive temperature coefficient resistor shunted between contacts that are disconnected sequentially so that voltage and current will be below a threshold at which arcing might occur, when each contact is separated from a mating contact.

2. Description of the Prior Art

Contacts carrying significant amounts of power will arc when disconnected. The amount of arc damage experienced by the contacts depends on their physical structure, the load current, the supply voltage, the speed of separation, the characteristics of the load (resistive, capacitive, inductive) as well as other factors.

Future automotive systems are expected to utilize 42 volts in order to reduce the load currents and the associated wiring losses. This increased voltage could cause significant arc damage to occur to the present connectors designed for 12-volt operation. To avoid the possible liabilities associated with catastrophic connector failure, automotive manufacturers are requesting a new connector design that can be hot-swapped some significant number of times. Ten cycles is considered to be a minimum requirement.

To disconnect 42-volt power without significant damage requires interrupting about 1500-watts for many loads and as much as 15 KW for the main battery circuit. Present day modules used in automotive applications can consume more than 500 watts. Power supplies must deliver one or more kilowatts of energy. Conventional solutions require either that the current be shut off before the contacts are separated or unmated or employ a sacrificial contact portion. The cost, space, reliability, safety, performance and complexity of these conventional solutions make them unsuitable for many applications, including automotive electrical systems.

There are many things known in the power utility profession that will quickly extinguish an arc and there are many things known in the relay industry that will minimize arc damage to connectors and contacts. These can be found in literature, such as *Gaseous Conductors* by James D. Cobine and the *Ney Contact Manual* by Kenneth E. Pitney. Most of these methods are not practical in smaller and separable electrical connectors such as those used in automobiles, computers and appliances. None of the methods provided in the literature will eliminate arcing. Conventional contacts will be destroyed when rated currents are interrupted often enough and slowly enough, even though these conventional contacts may rated for current interruption. There is a finite life for existing connectors since arcing will occur and cause damage each time the connector is disconnected under load.

U.S. Pat. No. 4,079,440 disclosed the use of an impedance element between a long and a short contact to avoid an arc and consequent damage to the short contact. The impedance element can be a fixed capacitance and an inductance is included to limit inrush current. It is suggested that a resistance or a resistance in series with a capacitor could also be used as an impedance element. U.S. Pat. No. 4,681,549 discloses the use of a current limiting resistor between long and short pads on a printed circuit board. The use of a constant impedance, capacitance or resistance in this manner will tend to limit or suppress an arc in only limited circumstances. Fixed capacitors and resistors are only suitable for a relatively small range of currents and voltages. An electrical connector will typically be used for a much larger range of currents and voltages than can be practically accommodated by a fixed capacitor or a fixed resistance, which may prevent or suppress arcing for only a portion of the applications in which an electrical connector will be used.

Positive Temperature Coefficient Resistance (PTC) Devices, resistors or switches have been used, or suggested for use, in circuit breakers that are used to break fault currents, specifically defined and excessive overcurrents, for which these circuit breakers are rated. On the other hand, electrical connectors are expected to carry a wide range of currents during actual use. Even though an electrical connector may be rated to carry a specific current, in actual practice, an electrical connector will carry currents over a large range due to variations in the load. The cost, size and weight of an electrical connector will generally increase with increasing current rating, so the lowest rated connector suitable for use in a specific application will normally be used. Because multiple loads with different current needs pass through a single connector, as well as for economic, inventory and connector product line consistency, it is not uncommon to minimize the number of different connectors utilized in a specific product. The net result, is that a specific connector will carry anywhere from its rated current, or even an overcurrent for safety and life testing, to some significantly lower current. If that connector is to be disconnected while carrying a current, or hot swapped, without arcing, arc prevention must be effective for a large range of currents, starting from the arc threshold current to the rated current for that connector. In other words, unlike circuit breakers, hot swapped connectors must be protected from arcing over a wide range of currents. Therefore use of a PTC resistor in the same manner as it is used in a circuit breaker will not be suitable for use in an electrical connector. The trip time varies for a PTC device in which resistance is dependent upon the temperature of the device, and the temperature is dependant upon current because of $I^2R$ heating. Thus the trip time for a PTC device used in an electrical connector will vary because of the wide range of currents that will be carried by a particular electrical connector.

When PTC resistance devices are used in switches, relays, fuses and circuit breakers, both halves of electrical contacts remain within the same physical device. The contacts separate from each other, but only by a well defined and fixed distance, and the separated contacts are still part of the device package. The essential function of electrical connectors is to totally separate the two contact halves. No physical connection remains between the two halves, and all physical ties are broken between two mating connector contacts. In order to protect separating electrical contacts that are carrying arc-producing power, the PTC device must be connected across the contact pair until the current is sufficiently reduced to prevent arcing. Thus, the problem is that a physical electrical connection to both halves of the separating electrical contact must be maintained in a conventional use of a PTC device yet, in a connector, all physical connections must be broken.

In switches, relays, fuses and circuit breakers, where prior art PTC devices are used; the distance of contact separation and the rate of separation are controlled. In these prior art devices, the contact separation needs to only be enough to hold off the rated voltage. The rate of separation can be made as fast as possible to shorten the time in which arcing could occur, therefore minimizing any associated damage. Electrical connectors must be completely separated. Electrical connectors are also manually separated, and the rate of separation varies widely for existing electrical connectors. Even for a specific manually separated electrical connector design, the rate of separation will vary significantly each time two electrical connectors are manually unmated.

SUMMARY OF THE INVENTION

To overcome these problems, the instant invention preferably employs a positive temperature coefficient (PTC) resistor in an electrical connector in series with an auxiliary electrical contact portion or contact terminal, the combination of which is in parallel with a main electrical contact portion or contact terminal, which disconnects first. This arrangement of components parts will prevent arcing when two electrical connectors are unmated while carrying current. Both the main and the auxiliary contacts are matable with a terminal or terminals in a mating electrical connector. In the preferred embodiments, the main and auxiliary contacts are male terminals or blades that mate with a female or receptacle terminal in the mating electrical connector. However, the PTC resistive member could also be employed with the female terminals. The PTC resistive member should, however, only be employed with the terminals in one half of a mating pair of electrical connectors. The main or auxiliary contact portions or terminals in one of the two connectors must incorporate the PTC member. When a conventional discrete PTC member, such as a commercially available POLYSWITCH® device, is used, the main and auxiliary contact portions or terminals in the other of the two mating connectors must be connected together directly, with no discrete PTC device between them. However, in other applications the PTC means may be located in both connectors.

A discrete PTC resistive member can be employed into the main and auxiliary contact terminals so that the PTC device can form an integrated unit. One means for forming such an integrated unit would be to mold a PTC conductive polymer between the main and auxiliary contact terminals. The PTC conductive polymer could also be overmolded around portions of the main and auxiliary contact terminals, with the PTC conductive polymer being molded between the main and auxiliary contact terminals. Insert molding techniques could be used to position the PTC conductive polymer between, the main and auxiliary contact terminals. The PTC conductive polymer could also be a discrete component that is molded as a shape that would conform to parts of the main and auxiliary contact terminals and this discrete component could be bonded between the main and auxiliary contact terminals using solder, a conductive adhesive or some other conductive bonding agent.

The main contact should unmate before the auxiliary contact, and in the representative embodiments depicted herein, the auxiliary contact is longer than the main contact. In the preferred embodiment, the PTC member comprises a conductive polymer member in which conductive particles are contained within a polymer matrix. Normally the conductive particles form a conductive path that have a resistance that is larger than the resistance of the main terminal so that under normal mated operation, the main contact would carry substantially all of the current. However, as current increases in the PTC member, the polymer expands and the resistance increases. When current through the PTC member increases rapidly due to disconnection of the main contact terminal, the resistance will increase rapidly due to $I^2R$ heating of the polymer. To prevent arcing when the main contact is unmated, the disconnect time for the main contact must be less than the time for the resistance of the PTC member to increase too greatly. Most of the current through the main contact must be carried by the PTC member and the auxiliary contact until the main contact has moved to a position in which arcing is no longer possible. Before the auxiliary contact is disconnected from the mating terminal, the resistance in the PTC member must increase so that the current flow through the auxiliary contact will drop below the arcing threshold before the auxiliary contact is unmated. This time is called the trip time of this PTC resitive member. Since the trip time of the PTC member will depend on the initial current through the main contact, which can vary over a wide range, the trip time for a given electrical connector will therefore not be constant. To insure that the PTC member will trip, the electrical connector of this invention employs latches that cannot be activated, after the disconnection of the main contact, for a time interval that will be greater than the maximum trip time for the PTC member. However, these latches must also permit rapid movement between the two electrical connectors as the main contact moves through a portion of its path in which it is susceptible to arcing. Similarly, the auxiliary contact must move rapidly through an arc susceptible region as it is disconnected. The preferred embodiments of this invention therefore use multiple sets of latches that must be sequentially disengaged, and which provide a time delay between disconnection of a first set of latches and the disconnection of a second set of latches. This time delay should be longer than the maximum PTC trip time. This multiple latch configuration provides a versatile implementation of the invention. If, however, a specific electrical connector serves loads with a small difference between maximum and minimum current loads, a simpler latch mechanism can be utilized. The maximum achievable parting velocity and the added length of the auxiliary contact could in some cases provide adequate time for the PTC device to trip.

BRIEF DESCRIPTION OF THE DRAWINGS

FIGS. 3A–3C are representative plots showing the trip times for various currents of electrical connector terminals according to this invention.

FIG. 5 is a view of mated plug and header electrical connectors, according to the first embodiment of this invention, showing the position of a PTC device connected between two contact terminals.

FIG. 6 is a view of two unmated electrical connectors incorporating the first embodiment of this invention, and the terminals shown in FIG. 5.

FIG. 7 is a view of the mated configuration of the two electrical connectors shown in FIG. 6.

FIG. 23 is a view of the mating face of the plug connector housing of the embodiment also shown in FIGS. 20–22.

FIG. 24 is a view of a lever that is used with the plug connector housing of FIG. 23.

FIG. 25 is a view of the mating face of the header housing of the embodiment of FIGS. 20–23.

FIG. 26 is a side view of the two mating connectors of the second embodiment in a first mating position, showing the application of a force for initially mating the two electrical connectors.

FIG. 27 is a three dimensional view of the two mating connectors in the position also shown in FIG. 26.

FIG. 28 is a detail view showing the position of the mating assist lever when the two connectors are in the position shown in FIGS. 26 and 27.

FIG. 29 is a side view of the two connectors of the second embodiment in a second position, showing application of a force to the mating assist lever.

FIG. 30 is a three dimensional view of the two connectors in the position of FIG. 29.

FIG. 31 is a view of the two connectors of the second embodiment, showing the two connectors in a fully mated configuration and also showing the manner in which the lever can be unlocked.

FIG. 32 is a three dimensional view of the two connectors in the position also shown in FIG. 31.

FIG. 33 is a side view of the two connectors in an intermediate position in which the lever has been unlatched. This figure illustrates the position in which the lever can be used to disconnect the main contact.

FIG. 34 is a three dimensional view of the two connectors in the position also shown in FIG. 33.

FIG. 35 shows the way in which latches are disengaged, after the lever has been rotated to its final position, so that the auxiliary contact terminal can be disengaged. The main contact is fully disengaged in this stage of the unmating cycle.

FIG. 36 is a three dimensional view of the two connector in the position also shown in FIG. 35.

FIG. 37 shows the two connectors in a fully unmated position.

FIG. 38 is a photograph showing the damage that would occur when one prior art connector configuration is disconnected one time at 59 V, while carrying a current of 60 Amps.

FIG. 39 is a photograph showing a contact terminal configuration similar to that shown in FIG. 38 in which the instant invention has been employed to protect the mating sections of the terminals after they have been disconnected fifty times at 59 Volts, while carrying a current of 60 Amps.

DETAILED DESCRIPTION OF THE PREFERRED EMBODIMENTS

Figure 1:
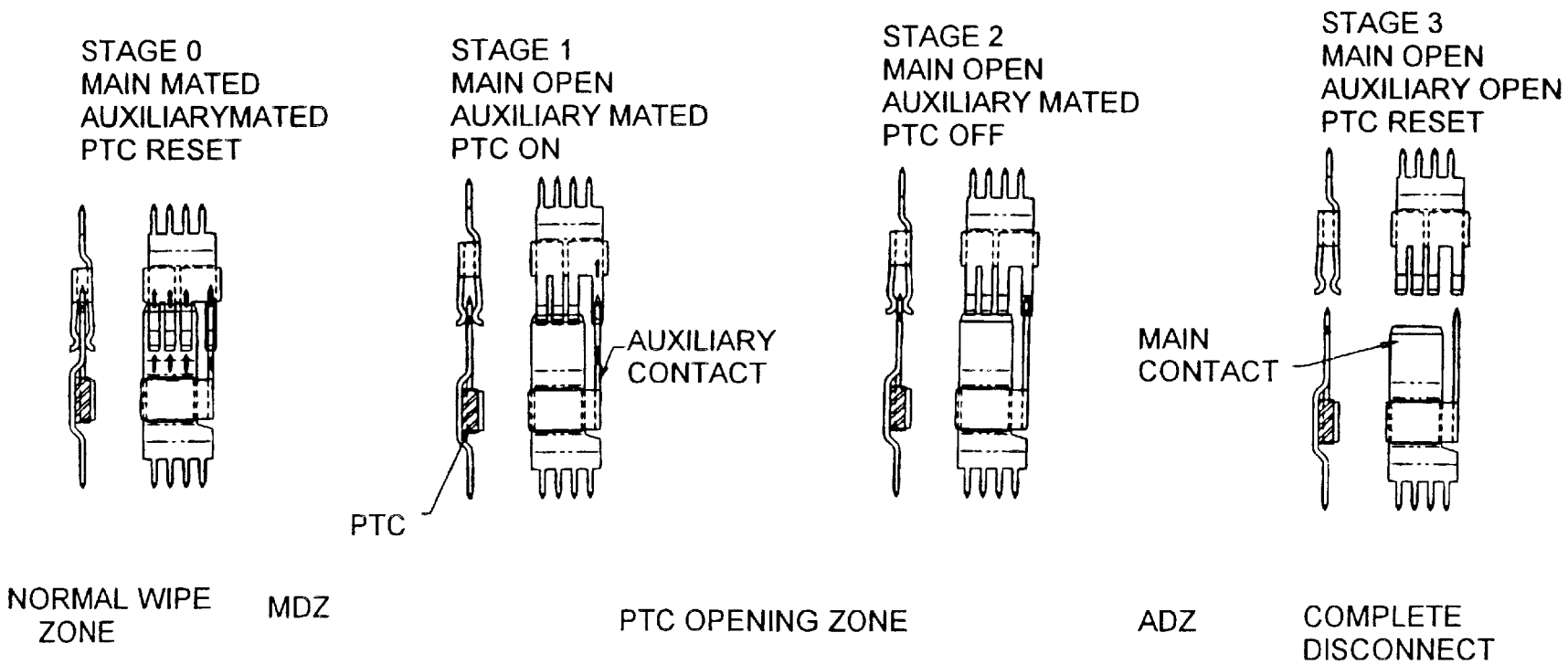
FIG. 1 is a view of the stages that a representative electrical connector terminal, according to this invention, will pass while being unmated.

A series of complex events lead to damaging arcs as contacts are separated while carrying substantial power. A simple description of the major events that occur in typical power contacts helps understand this phenomenon. First, as the contacts begin to separate, a point is reached where there is no longer enough metallic area to support the current flow. A very small molten bridge forms and breaks as the temperature and separation distance increase. Generally, this can occur at currents above 0.1 ampere and voltages greater than 9 volts. Enough current is needed to cause the melting and enough voltage is needed to sustain it and move to the next phase. As the molten micro-bridge boils and breaks, electrons are freed and current continues to flow by ionizing the intervening atmosphere. A true arc is the next result. This true arc consists of several sub-parts including the cathode spot, the cathode drop region, an extremely hot plasma channel, the anode drop region and the anode spot. The plasma channel is about 5000° C. and the anode and cathode spots reach about 2000° C. at 10–20 ampere currents.

If arcing is permitted to occur, mating contacts will be damaged. The degree of damage is controlled by many factors that determine the total arc energy. Primary ways to limit the arc energy are to minimize the current and voltage and by maximizing the separation velocity. There may be other means, but they do not lend themselves well to applications in which typical connector designs are utilized. For ordinary connectors, the only factor that can be controlled to a significant extent is the separation velocity.

By integrating a Positive Temperature Coefficient (PTC) resistance member into a two-piece contact, the voltage and current can be kept below the arcing threshold voltage and current when two connectors are unmated. This produces a contact that will not arc while interrupting significant energy as the connectors are disconnected. A PTC device, such as a discrete PTC resistor exemplified by a RHE 110 POLYSWITCH® device manufactured and sold by the Raychem division of Tyco Electronics Inc. may be employed. POLYSWITCH® is a registered trademark of Tyco Electronics Inc. The leads of the discrete device can be soldered to the respective main and auxiliary contacts. The leads on a discrete device could also be attached by contact springs or by crimps or by latching detents on the contacts. A conductive polymer, of the type exemplified by this discrete device can also be overmolded onto contact terminals to form a new component, or a PTC device can be integrated with the contact terminals to form an integrated component or unit. This approach may not eliminate the relatively benign spark that may occur when a high-energy circuit is connected. In the energy range of interest, this benign spark tends to do little damage to the contact base metal and to the shape of the contact. The general characteristics of POLYSWITCH® devices are discussed in U.S. Pat. No. 5,737,160 and the patents incorporated by reference therein. U.S. Pat. No. 5,737,160 and the other patent incorporated therein are in turn incorporated herein by reference for all purposes. The formulation of a conductive PTC device of the type used in a discrete POLYSWITCH® device is discussed in U.S. Pat. No. 6,104,587, which is incorporated herein by reference. This same formulation can also be used to form the conductive PTC polymer that can be molded into a shape compatible with the main and auxiliary contacts, or the PTC polymer can be overmolded or insert molded with the contact terminals as subsequently discussed with respect to the representative embodiments depicted herein.

FIG. 1 shows the concept for an arc-less power contact in accordance with the instant invention. Representative male and female, or blade and receptacle terminals, according to this invention, are shown in various stages of disconnection or unmating. There are three important components of the power contact illustrated in FIG. 1. The main contact, or the main portion of the contact, carries the load current during normal operation. The main contact is shunted by a series connected, longer auxiliary contact or contact portion and by a positive temperature coefficient resistance or resistor, located between the main contact and the auxiliary contact.

FIG. 1 illustrates the four stages that occur during separation of the plug connector from the mating receptacle connector. In stage 0, the contact is carrying a high current. The current is primarily flowing through the main contact or the main portion of the contact. Only a relatively small shunt current flows through the series connected positive temperature coefficient resistance or resistor (PTC) and the auxiliary portion of the contact. Stage 0 represents the normal operating configuration of a connector assembly. Relative movement of the two contacts in this position would result in the normal wiping action between two contact surfaces.

Stage 1 shows the configuration in which the main contact or main contact portion has been separated or disconnected from the mating contact in the other connector. The main blade is separated from the main receptacle through the main contact disconnect zone (MDZ), which occurs between Stage 0 and Stage 1, in which the main blade contact is in the process of unmating from the corresponding female or receptacle contact. While the two contacts are in this main disconnect zone, the two contacts are not completely separated. Contact bounce may occur as the spring members flex and as irregular surfaces on the contact result in momentary separation and engagement. It is while the main contact and the receptacle contact are in this contact disconnect zone (MDZ) that arcing between the two connectors is most likely, since a relatively large existing current is being disconnected. For a conventional prior art connector, arcing could occur across a small gap in the MDZ, if the voltage and current are above an arcing threshold for the particular connector configuration. However, in the instant invention, the voltage and current across the opening gap are limited by the positive temperature coefficient (PTC) resistor or resistance and the auxiliary contact or contact portion. Duration of the MDZ should be less than the trip time for the PTC device so that the PTC device does not switch to an OFF or open condition before completion of the separation between the contacts.

When the mating contacts have moved to the position identified as Stage 1, the main contact is physically separated from its mating contact so that arcing can no longer be initiated. Since there was only a small amount of current flowing through the PTC resistor during Stage 0, the $I^2R$ heating remained low causing the resistance of the PTC resistor to be in a low state when the contacts reached the position identified as Stage 1. Since the resistance is relatively low, current flows through the PTC resistor to the auxiliary contact and the PTC, which acts like a switch, can be said to be ON. While the auxiliary contact or auxiliary contact portion remains connected to the mating contact in the mating connector or to the same circuit in the mating connector, the current through the PTC resistor and the auxiliary contact will be greater than in Stage 1 and therefore $I^2$ R heating will increase. The resistance of the PTC resistor increases with increasing temperature. Stage 2 illustrates this configuration in which the longer auxiliary contact remains connected to the mating contact as physical unmating or relative movement between the connectors and contact terminals continues. Stage 2 illustrates a snapshot of one position of the contacts during the time after the main contact is separated and before disconnection of the auxiliary contact. It is during Stage 2 that the PTC resistor will open or, in other words, its resistance will significantly increase. Therefore, the PTC switch is now in the OFF position.

Prior to the time that the auxiliary contact separates from the mating contact, or from the circuit including the mating contact, the current flowing through the auxiliary contact will be below the arcing threshold. This is due to the increased resistance of the PTC during the time when relative movement of the two terminals or connectors occurs. This range of movement within the disconnect travel is called the PTC Opening Zone. When the auxiliary contact finally separates at Stage 3, there is only a small amount of leakage current flowing through the connectors. At this point there will be insufficient electrical energy to support an arc between the auxiliary contact portions. Enough time should elapse while the terminals or connectors are in the PTC opening zone, so that the current is below the arcing threshold before the auxiliary contact is physically disconnected from the receptacle contact in the Auxiliary Disconnect Zone (ADZ). Stage 3 shows the mating contacts completely separated and disconnected with both the main contact and the auxiliary contact open. Since current is no longer flowing through the connectors, the PTC resistor will return to the RESET state of lower temperature and resistance. The contact assembly will then be in a state so that they will again function so that arcing will not occur when the connectors are unmated under load.

Preferably, this contact configuration is employed in a connector housing that provides velocity control to assure that the timing of the stages illustrated in FIG. 1 will be appropriate. The housing should also assure that unmating velocity is unidirectional. That is to say there should be no macro break-make-break action of the main contact as the connector separates. Nanosecond or micro discontinuities will occur, but these micro break-make-break actions will not interfere with the arc protection because the PTC resistor will be chosen to react much slower than these relatively high speed events. All four stages should be passed in a unidirectional and sequential manner.

The blade contact of FIG. 1 mates with the receptacle contact, which has flexible spring beams mating with the plug or blade contact. The plug or blade contact includes a main contact or main contact portion and an auxiliary contact or auxiliary contact portion. In this embodiment, the main contact and the auxiliary contact are two separate metal blades that each engage separate spring beams on the receptacle contact. In this representative configuration, the receptacle contact comprises a single piece metal member with separate spring beams engaging the main contact and the auxiliary contact respectively. The main contact and the mating receptacle contact are each printed circuit board style contacts with multiple leads extending from rear ends of each contact. The auxiliary contact or blade does not include means, such as the PCB leads, for connection to the external circuit independently of the main contact. The PTC resistor employed in this invention can comprise a molded member that can be bonded along at least one side to the central section of the main contact. A suitable conductive adhesive can be employed if necessary. The auxiliary contact is bonded to the PTC resistor along another side so that the PTC member is located physically and electrically between the main contact and the auxiliary contact. Stages 0–3 show the relative positions of the contacts as a connector in which these contacts are included are unmated. The PTC member employed herein preferably comprises a conductive polymer that can be molded to the desired shape. Conductive particulate fillers, such as carbon black, are dispersed in a nonconductive polymer to form a conductive path having a resistance that is dependent upon the temperature and state of the polymer. Devices employing a conductive polymer are well known and are available from Tyco Electronics. These POLYSWITCH® devices are employed in other applications. Barium-Titanate or semiconductor material exhibiting PTC behavior might also be employed, but these alternative PTC materials may prove too expensive for practical use in electrical connectors.

Figure 2:
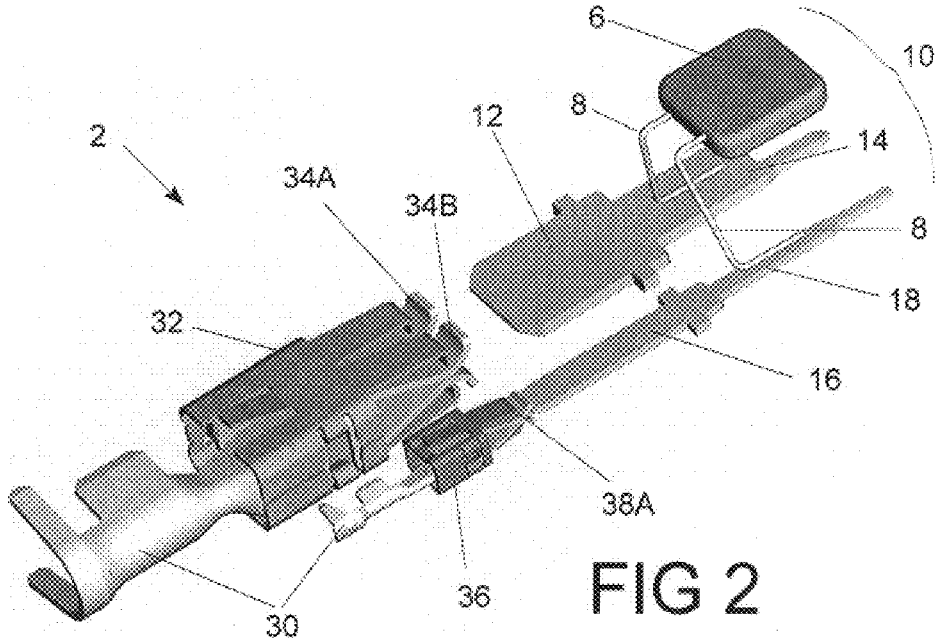
FIG. 2 is a view of mating contact terminals, according to a configuration used to demonstrate the characteristics of an electrical connector employing this invention.

FIG. 2 is a view of a sample contact terminal configuration 2 that is used to demonstrate the performance of this invention when terminals are cycled in the manner shown in FIG. 1. The sample configuration shown in FIG. 2 includes two male terminal blades 12, 16. A main terminal blade 12 is connected in series to a longer auxiliary terminal blade 16 by a discrete PTC device 6. In this configuration a PTC device having characteristics generally equivalent to a Tyco Electronics RHE 110 is employed. Leads 8 are soldered to the main and auxiliary terminal blades 12, 16. These terminal blades 12, 16, connected in series by the PTC device, can be mated with and unmated from two receptacle terminals 32, 36, which will be connected in parallel to a common external conductor. Each of the main terminals 12 and 32, shown in FIG. 2 can continuously carry all of the current employed herein. The auxiliary terminals 16, 36 carry the full current only for as long as it takes for the POLYSWITCH® device to trip or open. The two receptacle terminals 32, 36 can be considered to represent one terminal having multiple spring members 34A, B and 38A for contacting two separate blades 12, 16. The auxiliary blade 16 is longer than the main blade, so it will connect first and disconnect last from the receptacle terminal assembly 30.

Figure 4:
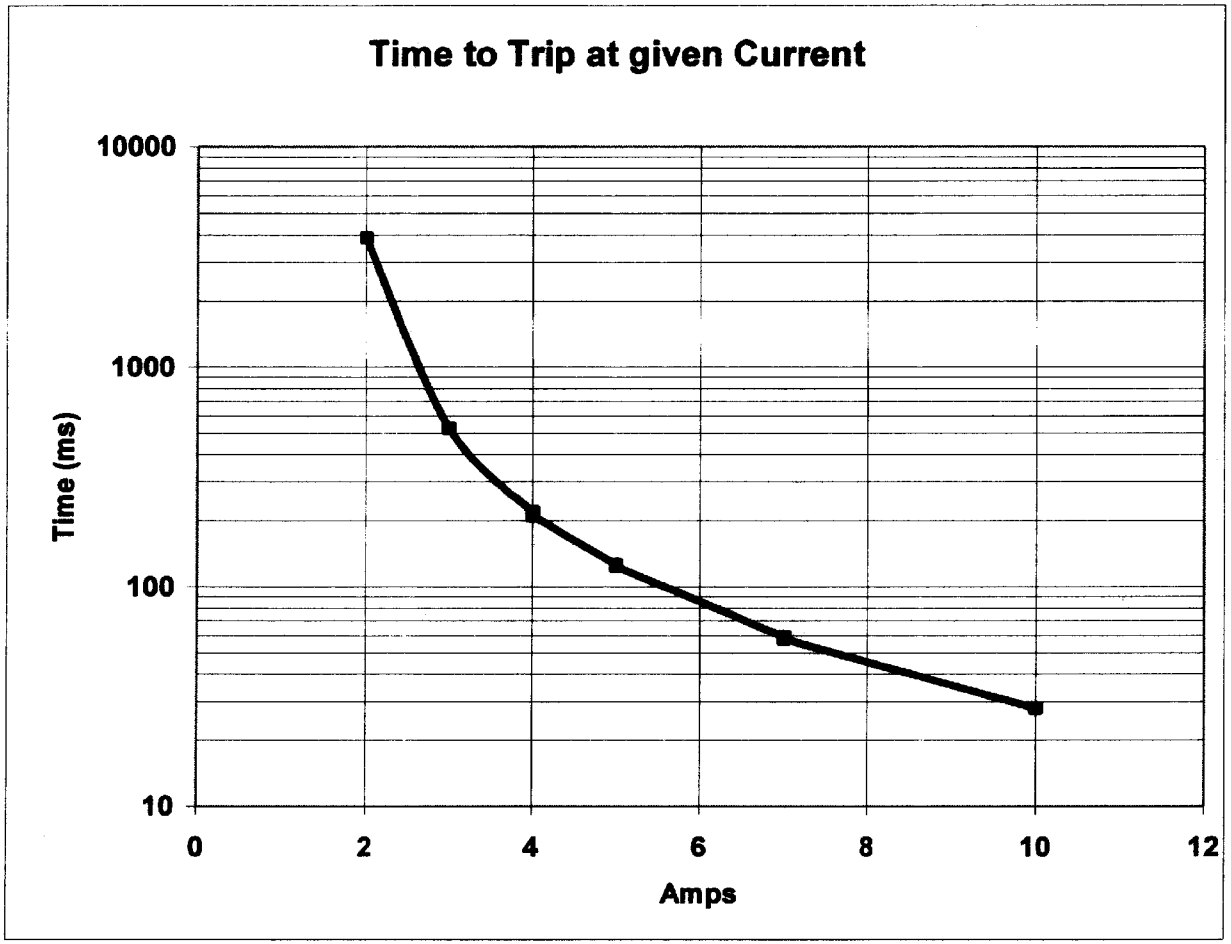
FIG. 4 is a plot showing the variation of trip time to current.

FIGS. 3A to 3C and FIG. 4 show the relationship between current and trip time for a connector and contact terminal using a PTC resistance device in the manner described herein. FIGS. 3A through 3C are plots showing waveforms of the voltage as mating contacts were disconnected under power. FIG. 3A shows the results of the second and tenth cycling for contacts that were cycled with two amps being carried by the mating contacts. FIG. 3B shows the results of the second and tenth cycle for the same contact configuration in which five amps were carried by the mating contacts. FIG. 3C shows waveforms for a ten amp test in which the first, tenth, thirty-third, thirty-sixth and fiftieth cycles are recorded. FIG. 3C also shows the difference between waveforms in which no arcing occurred and in which arcing occurred when the PTC material was not permitted to return to its ON condition before the contacts were again disconnected. Comparison between these waveforms in FIG. 3C, shows the effectiveness of the the PTC material. Comparison of FIGS. 3A–3C shows that the time to disconnect the two mating contact terminals differed for different currents. In other words, the unmating velocity was not the same for each waveform. Trip-time for the PTC resistance device, used herein, as a function of current is shown in FIG. 4.

FIGS. 5–11 show an electrical connector assembly 4 that can be employed with the contact configuration 2 of FIG. 2 and with a discrete conductive polymer PTC device or switch 6, such as the Tyco Electronics RHE110. FIG. 5 shows a portion of a mated header and plug connector configuration 4 in which a discrete conductive polymer PTC device 6 is employed. The discrete PTC device 6 is inserted into a pocket 48 formed on the rear or printed circuit board side of a molded receptacle header housing 42. This pocket 48 retains the conductive polymer PTC device 6, but it provides sufficient space to permit the PTC device 6 to expand. The leads 8 on the discrete PTC device 6 are soldered directly to a rear portion 14 of the main contact member 12 and to a rear portion 18 of the auxiliary contact member 16 In this configuration only the main contact member 12 in the header 40 would be attached directly to an external conductor on a printed circuit board. The auxiliary contact member 16 would not be connected to an external conductor through the printed circuit board. Its only contact with an external conductor would be either through the discrete PTC member 6, or in the mated configuration, through the auxiliary receptacle terminal 36 to which it is mated.

FIGS. 6 and 7 show the manner in which this embodiment insures that the PTC resistive device 6 is in the proper state during disconnection of the main contact 12 and disconnection of the auxiliary contact 16. The plug connector housing 52 and the header housing 42 of FIGS. 6 and 7 have two separate latching mechanisms that must be independently actuated in order to unmate the plug connector 50 from the header 40. As seen in FIGS. 6–9, the plug connector housing 52 has two separate sets of two latches 54A, B and 60A, B. The header 40 has two sets of two latch detents 44A, B and 46A, B. One set of latches 54A, B on the top and bottom of the plug connector housing 52 are engagable with and disengagable from one set of latching detents 44A, B also on the top and bottom of the header housing 42. A second or auxiliary set of latches 60A, B on opposite sides of the plug housing 52 are engagable with and disengagable from a second or auxiliary set of latching detents 46A, B on the sides of the header housing 42. As shown in FIG. 6, the latching detent 44A on the top of the header housing 42 is spaced further from the mating end of the header housing 42 than a latching detent 46A, B on an adjacent side of the header housing 42. The latching detent 44B on the bottom of the header housing 42, hidden in FIG. 6, is in the same axial position as the latching detent 44A on the top of the header housing 42. Similarly the hidden latching detent 46B on the opposite side of the header housing 42 is at the same axial position as the latching detent 46A on the front side of the header housing 42 as viewed in FIG. 6. In the fully mated configuration of FIG. 7, the latches 54A, B on the top and bottom of the plug connector housing 52 grip the top and bottom latching detents 44A, B on the header housing 42.

Figure 8:
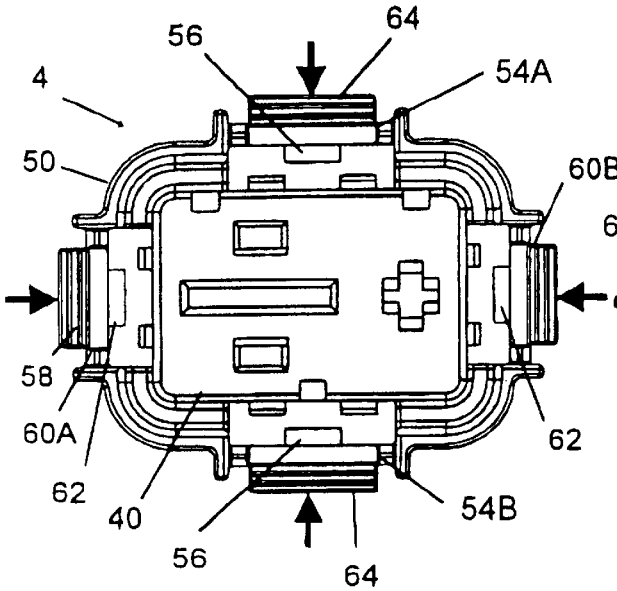
FIG. 8 is a view of the mating face of a plug connector incorporating receptacle contact terminals according to this invention.
Figure 9:
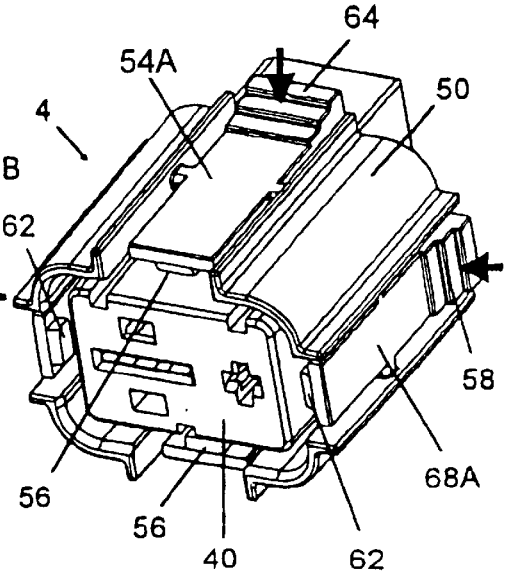
FIG. 9 is a three dimensional view of the plug connector shown in FIG. 8 showing the sequential latches employed in the first embodiment of this invention.
Figure 10:
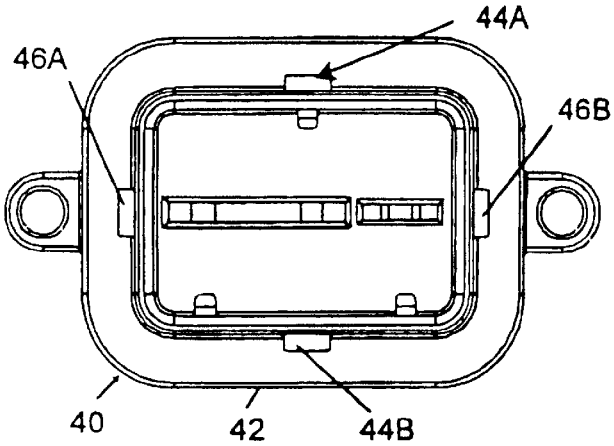
FIG. 10 is a view of a header connector housing, matable with the plug connector shown in FIGS. 8 and 9.
Figure 11:
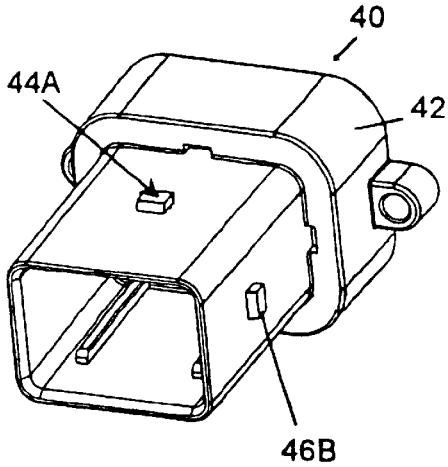
FIG. 11 is a three dimensional view of the header shown in FIG. 10, showing two latching detents that are located at different positions along the mating axis of the electrical connector.

As seen in FIGS. 8 and 9, the plug connector latches 58A, B and 60A, B can be disengaged from the latching detents 44A, B and 46A, B by pressing on the opposite end 58, 64 of each latch to disengage a latching protrusion 56, 62 on the remote end of the latches from a corresponding detent on the header 40 The arrows in FIGS. 8 and 9 show the locations on the latches 58A, B and 60A, B to which force is applied to release the latches from the detents. In order to disconnect the fully mated plug connector 50 from the header 40, it is necessary to first disengage the top and bottom or main latches 58A, B from the corresponding top and bottom or main detents 44A, B. As previously discussed with reference to FIG. 6, the top and bottom detents 44A, B are further from the header mating end than the side or auxiliary detents 46A, B. Thus in the fully mated configuration, the latch protrusions 56 and 62, which are at the same axial position for top, bottom and side latches, will only engage on the top and bottom detents 44A, B. Thus the top and bottom latches 58A, B must be disengaged first. If an attempt is made to first disengage the side latches 60A, B the plug connector 50 cannot be unmated from the header 40, because the top and bottom main latch protrusions 56 will still engage the top and bottom main detents 44A, B to lock the two connector halves 40, 50 in the fully mated configuration.

After the top and bottom main latches 54A, B are disengaged from the top and bottom main detents 44A B, the plug connector 50 can be moved in the axial direction to partially unmate the two connectors 40, 50. However, a short axial movement of the plug connector 50 relative to the header 40 will bring latching protrusions 62 on the interior of the side auxiliary latches 60A, B into engagement with the side detents 46A, B on the header housing 42. The side latches 60A, B can then be manually depressed to disengage them from the side detents 46A, B so that the mating electrical connectors 40, 50 can be completely unmated. However, in order to depress the side latches 60A, B, a person seeking to disconnect the two connectors 40, 50 will first have to release the top and bottom latches 54A, B and rotate his or her hand to subsequently grip the side latches 60A, B. This manual operation will take some time. Therefore the two connectors 40, 50 can only be unmated in a sequential fashion with some finite time delay between disengagement of the two sets of detents 44A, B and 46A, B. Disconnection or unmating is therefore a two-stage process. The time delay dictated by the two separate sets of latches and protrusions is important if the connector is to disconnect a large range of currents, because it is used to insure that the PTC device 6 is in the proper state during the Main Disconnect Zone (MDZ) and the Auxiliary Disconnect Zone (ADZ) as illustrated in FIG. 1. Release of the top and bottom latches 54A, B corresponds to the movement of the mating contacts 2, as shown in FIG. 2, from Stage 0 to Stage 1 as shown in FIG. 1. In other words, disengagement of the top and bottom latches 54A, B and detents 44A, B allows movement of the mating contact terminals 2 through the MDZ in which the main contact 12 is disconnected from the main receptacle terminal 32. Since the PTC resistive device 6 is in the ON state at this time, substantially all of the current formerly flowing through the main contact terminals 12 and 32 will initially flow through the PTC device 6 and through the auxiliary contact 16, which is still connected to the auxiliary receptacle terminal 36. This will allow the main contact to be disconnected or unmated without arcing.

Hand motion from the top and bottom latches 54A, B to the side latches 60A, B that release the side detents 46A, B will allow the mated connector PTC to transition from Stage 2 to Stage 3 as illustrated in FIG. 1. Then the release of the side latches 60A, B from the side detents 46A, B will allow the connectors 40, 50 to rapidly move through the Auxiliary Disconnect Zone (ADZ) to subsequently disconnect the auxiliary contact 16 from its mating auxiliary receptacle terminal 36. Since the current flow through the auxiliary contact 16 has decayed sufficiently before movement of the auxiliary contact 16 through the ADZ, there will be no arcing when the longer auxiliary contact 16 is disconnected or unmated from the auxiliary receptacle terminal 36. The time delay created by the sequential manipulation of the two separate set of latches will provide an adequate time for the polymeric material in the PTC device 6 to heat up due to $I^2R$ heating and switch the PTC device 6 to the OFF or high resistive state. This time delay will be sufficient to overcome the large difference in PTC trip time that can be expected when a specific connector design could be disconnected over a range of different currents. Identical connector assemblies can then be used in diverse applications where the current is unknown and can range from the arcing threshold for that given connector up to and perhaps momentarily beyond its maximum rated current.

The detents 44A, B and 46A, B can also function as inertial detents so that the latches 58A, B and 60A, B will force the connectors to one side or the other of both the MDZ and the ADZ where arcing would occur without the full range of protection provided by this contact and connector design. The connectors 40, 50 thus cannot be stuck in a position in which arcing could occur. The contour of these detents can also be chosen to accelerate the connectors 40, 50 through the MDZ and the ADZ further reducing the possibility for an arc to form. The use of inertial detents is this manner is discussed in greater detail in U.S. patent application Ser. No. 09/929,432 filed on Aug. 14, 2001, which is incorporated herein by reference.

A second embodiment of a connector terminal 110 implementing this invention is shown in FIGS. 12–19. This terminal 110 also includes a main contact 112, a longer auxiliary contact 130 and a conductive polymer PTC resistive member 140 between the two contacts 112 and 130. In this embodiment a discrete PTC device, such as a POLYSWITCH® device, is replaced by an overmolded conductive polymer that has similar active characteristics. The conductive polymer is overmolded around portions of the main and auxiliary contacts 112, 130.

Figure 12:
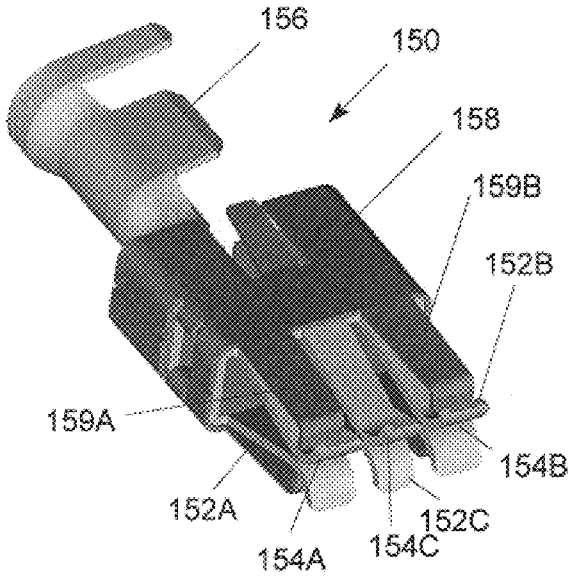
FIG. 12 is a three dimensional view of a receptacle contact terminal comprising a second embodiment of this invention.
Figure 13:
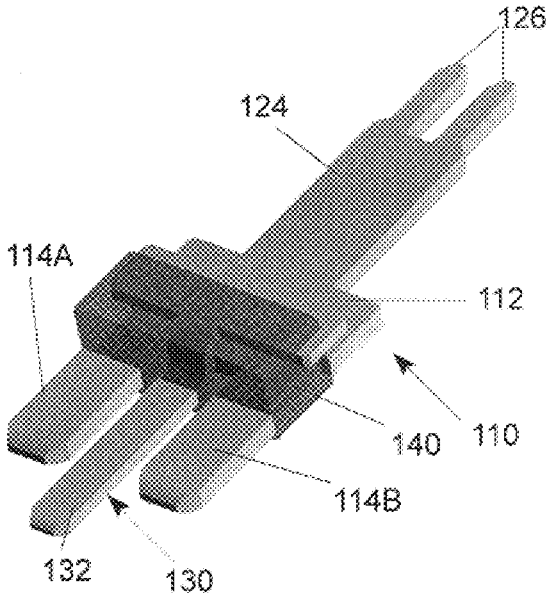
FIG. 13 is a three dimensional view of a blade contact terminal comprising a second embodiment of this invention.

The receptacle terminal 150 used in this second embodiment is shown in FIG. 12. The male or blade terminal 110 that mates with the receptacle terminal 150 is shown in FIG. 13. The receptacle terminal 150 has three sets of opposed springs 152A, B, C located on the front of the receptacle contact terminal 150. These springs 152A, B, C have contact points 154A, B, C located near the distal or front ends of the springs, which each comprise curved cantilever beams. A crimp section 156 is located on the rear of this receptacle terminal 150, and a single external conductor or wire can be crimped to this receptacle terminal.

The male or blade terminal 110, shown in FIG. 13, has two main contact blades 114A, B located on opposite sides of the longer auxiliary contact 130 located between the two main blade contacts 114A, B. The auxiliary contact 130 is attached both physically and electrically to the main contacts 112 by the overmolded PTC conductive polymer 140. Each of the contacts 112, 130 extend forward from the conductive polymer 140 into a position in which they can be inserted into engagement with the springs 152A, B, C on the mating receptacle terminal 150. This blade terminal 110 also extends from the rear of the overmolded conductive polymer 140 with printed circuit board leads 126 located at the rearmost extent. This rear section 124 is part of a single stamped and formed member that also includes the two main contact sections 114A, B. The auxiliary contact 130 is a separate piece that is mounted on to this main contact terminal 110 by the overmolded PTC conductive polymer 140.

Figure 14:
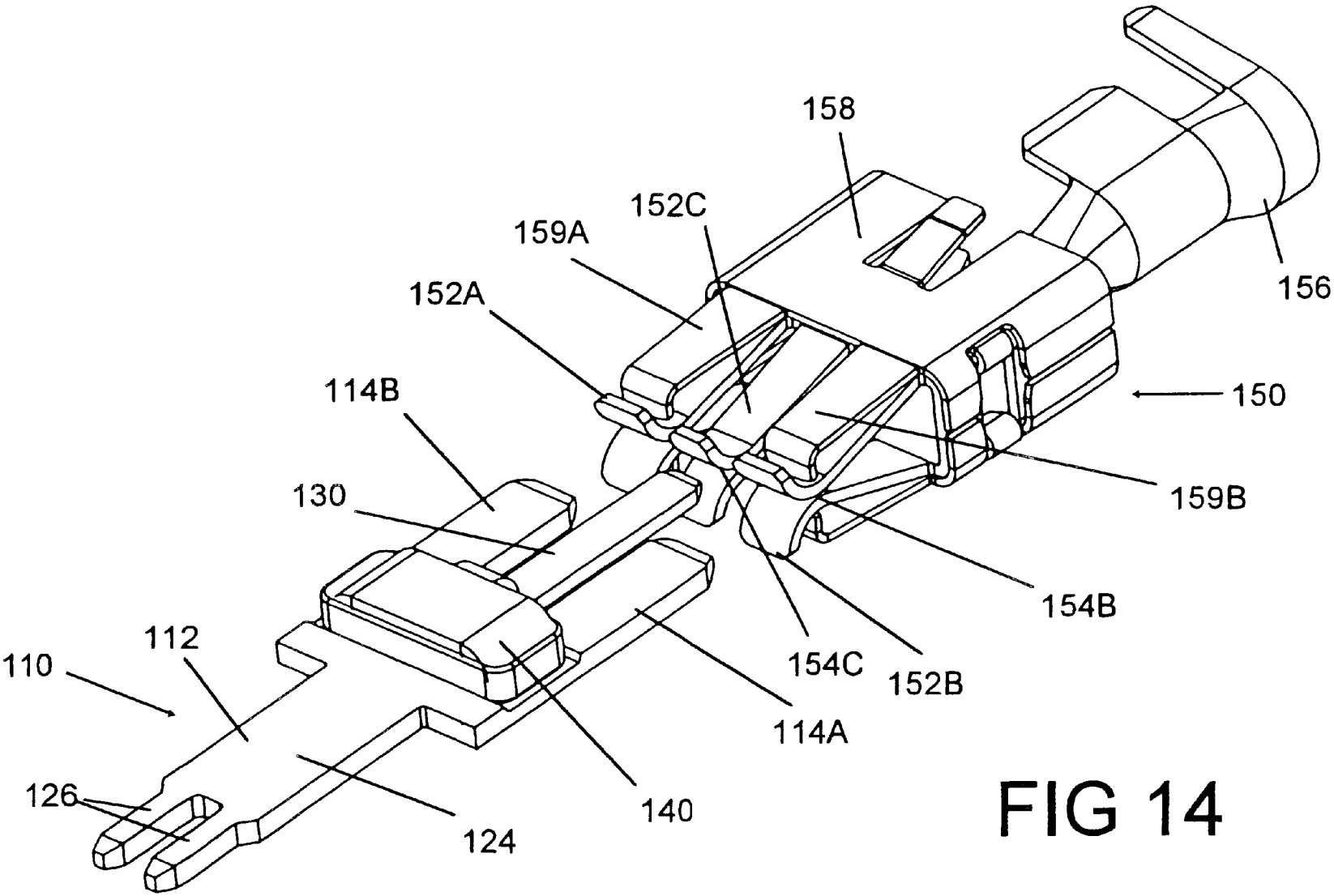
FIG. 14 is a view in which the mating terminals of FIGS. 12 and 13 are aligned prior to mating.
Figure 15:
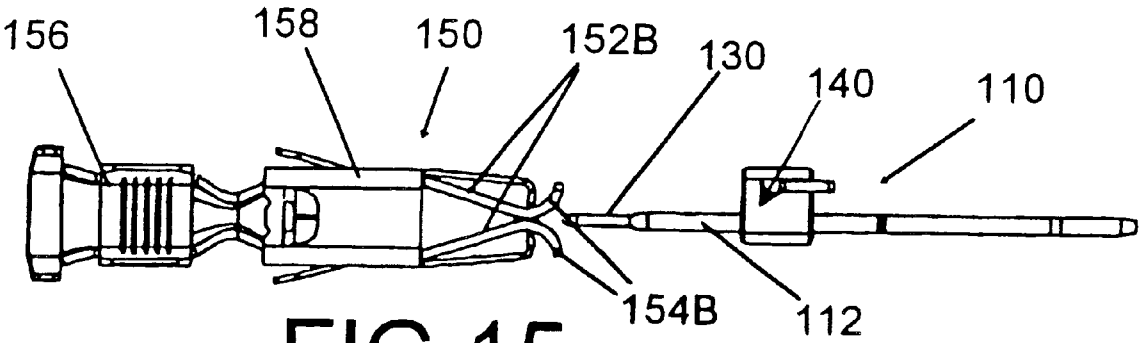
FIG. 15 is a side view of the mating terminals shown in FIG. 14.
Figure 16:
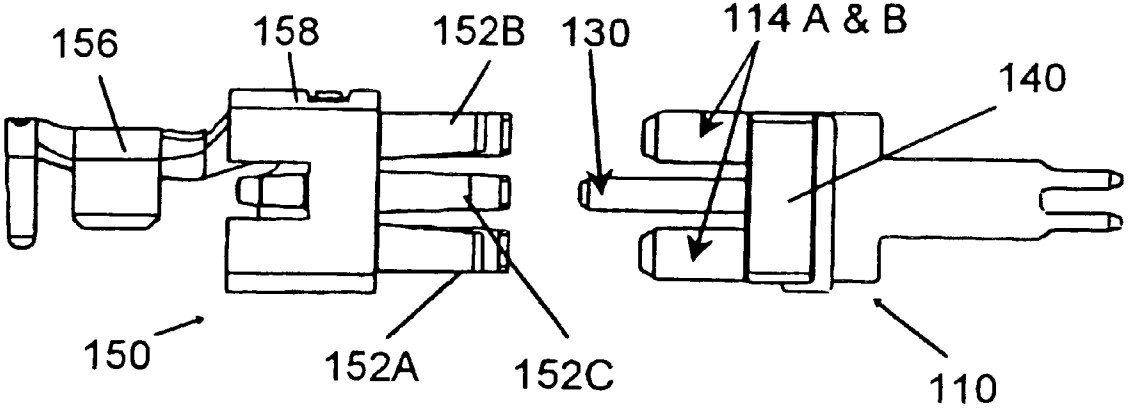
FIG. 16 is a top view of the mating terminals shown in FIGS. 14 and 15.

FIGS. 14–16 show the matable blade terminal 110 and receptacle terminal 150 of FIGS. 12 and 13. As shown in FIGS. 14–16, the receptacle terminal 150 also includes a separate sleeve 158 that surrounds the base of the terminal 150 and includes back up beams 159A, B supporting the outermost springs 152A, B that engage the main contact sections 114A, B of the blade terminal. These backup beams 159A, B increase the contact force between the main contact blades 114A, B and the receptacle terminals 150. During normal operation, the main contact 112 will carry most if not substantially all of the current carried by the mating connectors 104 and 106, first indicated in FIG. 20, and this additional contact force will improve the performance of the connectors. The central springs 152C, on the receptacle terminal 150, are not backed up by beams extending from the sleeve 158. These central springs 152C will only engage the auxiliary blade contact 130, which during normal operation will only carry a relatively insignificant current. Only momentarily, during mating and unmating, will the auxiliary contact conduct any significant current, so back up beams are not necessary.

Figure 17:
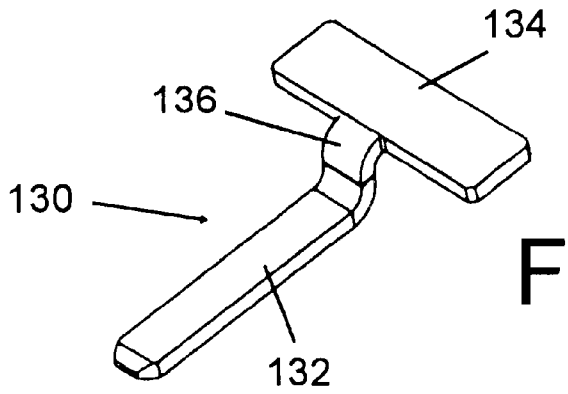
FIG. 17 is a view of the auxiliary contact terminal of the second embodiment of this invention.
Figure 18:
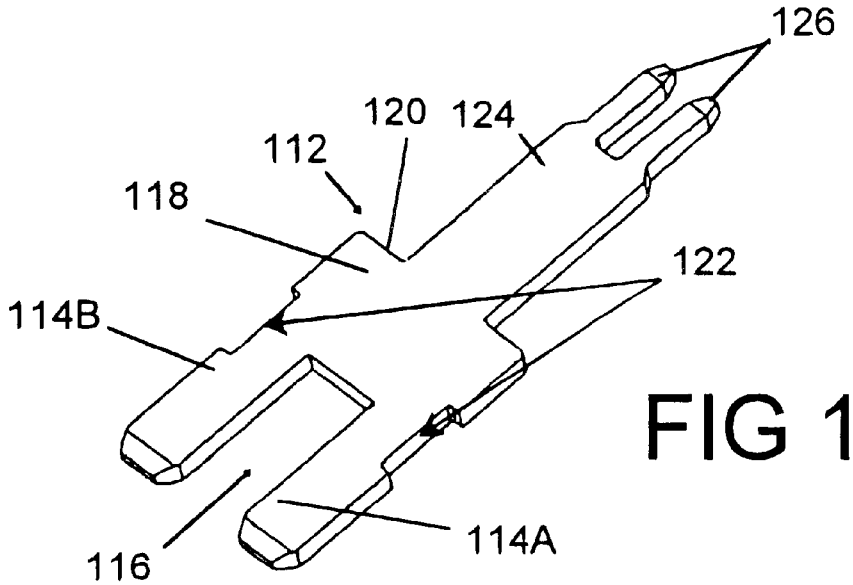
FIG. 18 is a view of the main contact terminal of the second embodiment of this invention.

FIG. 17 shows the stamped and formed metal auxiliary blade contact 130, and FIG. 18 shows the stamped and formed main contact 112. The auxiliary contact 130 includes a contact section 132 in the form of a standard blade that is typically used to mate with a receptacle terminal 150 having spring beams 152C to engage the blade section 132. The auxiliary contact 130 will typically be plated in the blade contact section 132 so that a reliable electrical contact can be established. The auxiliary contact also includes a transverse cross member 134 located at the rear of the blade contact section 132. This cross member 134 is in a plane that is offset and is parallel relative to the plane of the auxiliary blade contact section 132. The blade contact section 132 is joined to the cross member 134 by an intermediate section 136 that extends between the two planes of the two primary elements of the auxiliary contact. The cross member 134 is spaced from the blade contact section 132 so that the cross member 134 will also be spaced from the main contact 112 to provide space for the PTC conductive polymer 140 that will be positioned between the auxiliary contact 130 and the main contact 112.

The main contact 112 is an essentially flat stamped and formed metal member that has two main contact sections 114A, B that are spaced apart on opposite sides of a central cutout 116 that extends from the front of the main contact 112 to a middle section 118. The width of this cutout 116 is sufficient to receive the blade contact section 132 of the auxiliary contact 130 and to provide an adequate separation between the auxiliary blade section 132 and both main contact blade sections 114A, B. A rear section 124 of the main contact 112 extends from a rear edge 120 of the middle section 118, and includes two pins or leads 126 that can be inserted into through holes in a printed circuit board to connect external conductors on the printed circuit board to the main contact 112. There is no direct connection between external conductors to the auxiliary contact 130, other than through the overmolded PTC conductive polymer 140 or when connected to the mating receptacle terminal 150. The main contact terminal 112 also includes two notches 122 on opposite edges to provide surface for securing the main contact 112 to the PTC conductive polymer 140.

Figure 19:
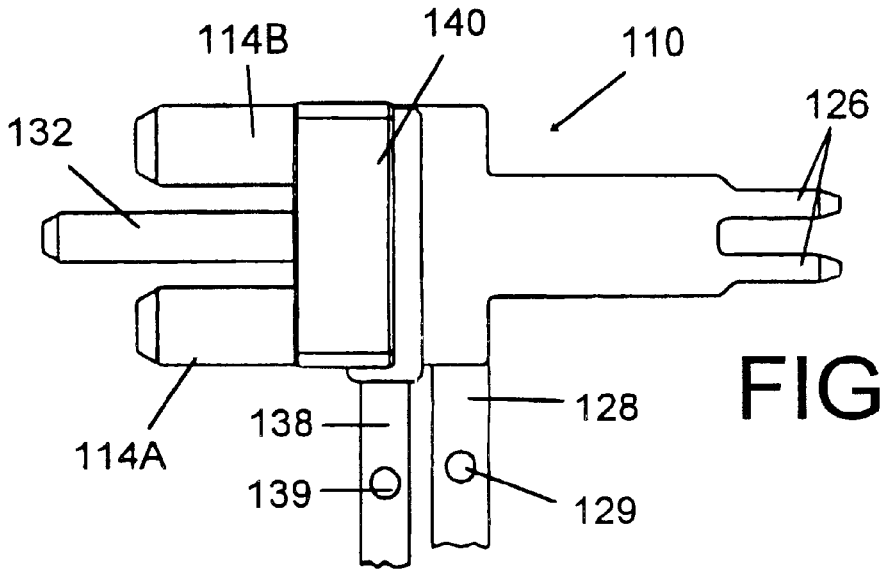
FIG. 19 is a view showing the manner in which the main and auxiliary contact terminals are position so that a PTC material can be overmolded.

FIG. 19 demonstrates the manner in which the PTC conductive polymer 140 can be overmolded around the auxiliary contact 130 and main contact 112, or alternatively in which the two contacts 112, 130 can be insert molded in the PTC conductive polymer 140. Each of the contacts 112, 130 are mounted onto a carrier strip 128, 138. FIG. 19 shows these two carrier strips 128, 138 and pilot holes 129, 139 in each carrier strip. These pilot holes 129, 139 provide a means for properly locating the two contact members 112, 130. The two aligned contact members 112, 130 are then positioned in a mold cavity. Since the auxiliary blade portions 132 and the two main contact blade sections 114A, B are in the same plane, the mold can be easily closed around these planar members. The conductive polymer can then be molded in surrounding relationship relative to the portions of the auxiliary contact 130 and main contact 112 that are positioned in the mold cavity. After the conductive polymer has sufficiently cooled to solidify, the contact assembly can be removed from the mold cavity and the carrier strips 128, 138 can be removed at the appropriate time. This will leave a blade terminal assembly 102 that can be mounted in an electrical connector housing, such as a header housing 200 having many of the characteristics of a conventional printed circuit board header.

Figure 20:
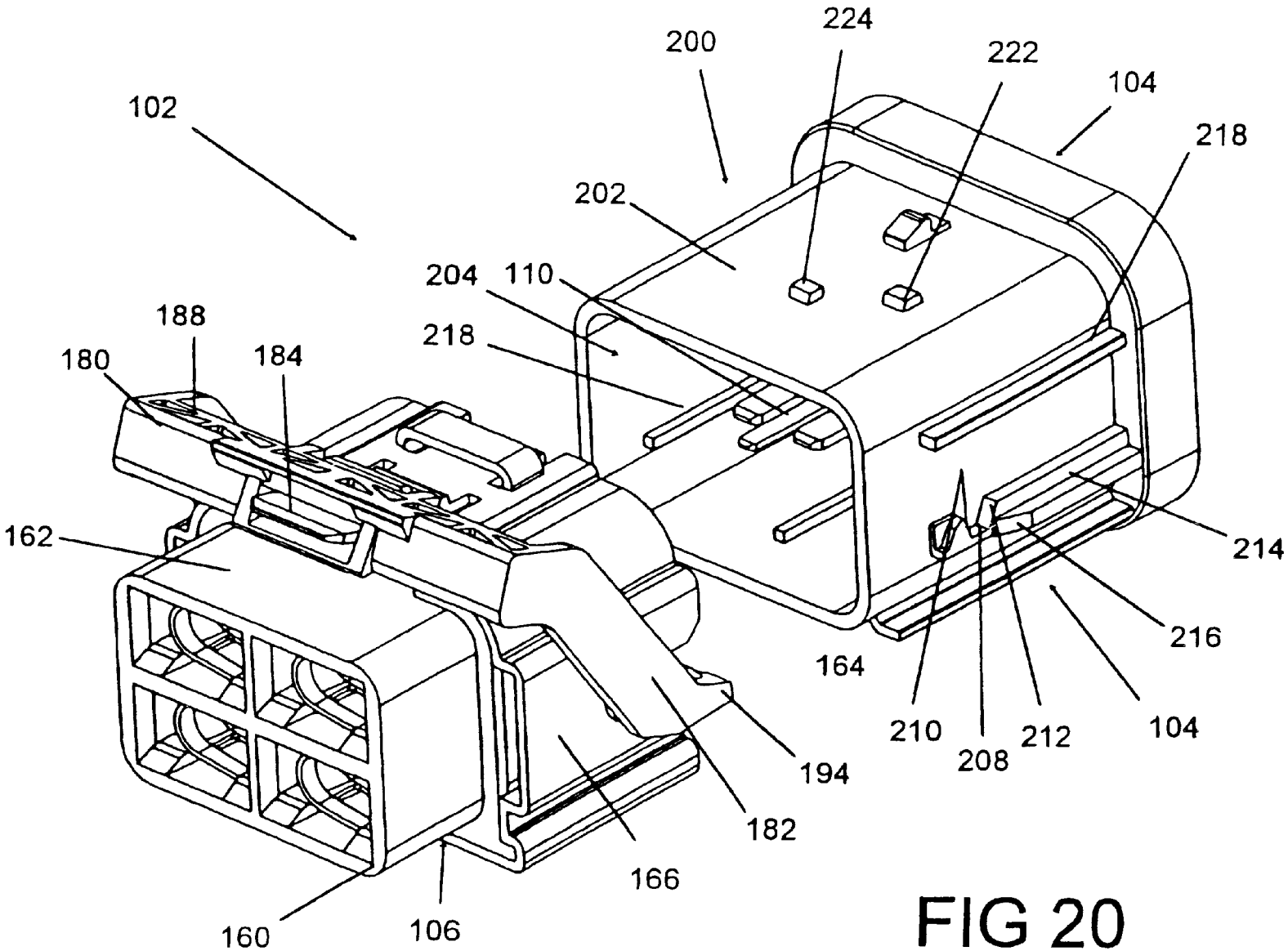
FIG. 20 is a view of the matable plug and header connectors according to the second embodiment of this invention.

The embodiment of FIGS. 12–19 is representative of an integrated terminal or contact including a main contact, an auxiliary contact and a PTC conductive polymer. An integrated terminal or contact can be fabricated by means other than the overmolding or insert molding fabrication method illustrated by this specific embodiment. For example, it is not necessary to mold the PTC conductive polymer in surrounding relation to both the main and auxiliary contacts. PTC material or a PTC device only needs to be located between the main and auxiliary contacts. An integrated device can be fabricated by bonding a PTC device between the two contacts. A PTC device may be secured to the contacts by soldering the PTC device to one or both contacts or by using a conductive adhesive or other conductive interconnection means. The integral terminal assembly could be formed by first molding the PTC conductive polymer in a shape so that it would conform to both terminals, which would then be positioned in engagement or close proximity to the molded PTC device and then secured or bonded to form an electrical connection. Molding would not be the only process that could be used to form a discrete PTC device that is then to be incorporated into an integral assembly. For example, some other fabrication technology would be employed for nonpolymeric PTC materials. Another fabrication technique would be to mold the PTC material between the two contacts, but not in surrounding relationship. Another approach would be to place one of the contacts in a mold and then mold the PTC conductive polymer in contact with this one contact or terminal. The other contact or terminal could then be bonded to the PTC polymer by solder, conductive adhesive or some other conductive bonding agent. Additionally the structure of the main and auxiliary contacts used in the embodiment of FIGS. 12–19 is merely representative, and other integrated contacts may include contacts or terminals of different construction or shape. For example, only one main contact may be needed in other configurations. Furthermore, other embodiments might employ female or receptacle terminals that are part of an integral terminal device including a PTC device or PTC conductive material. FIGS. 20–37 show details of the electrical connector housings 160, 200 and the electrical connectors 104, 106 in which the receptacle terminal 130 and blade terminal 110 of this second embodiment could be employed. The blade terminal 110 is positioned within a header housing 200 of generally conventional construction, except for provisions unique to the blade terminal 110 depicted in FIGS. 13–16. The receptacle terminal 150 shown in FIG. 12 is mounted in a plug connector housing 160 that is matable with the header housing 200. FIG. 20 shows that the receptacle terminal 150 and the blade terminal 110 can be employed in connectors that also include conventional receptacle terminals and blade terminals that are employed on circuits where the current would always be below the arcing threshold for that type of terminal.

Figure 22:
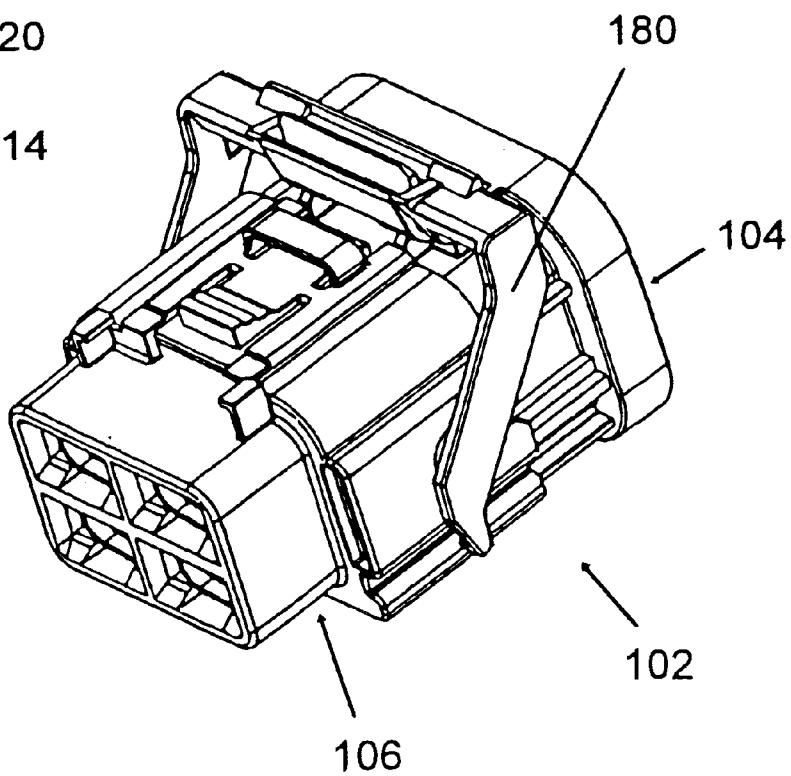
FIG. 22 is a view showing the plug and header connectors of FIGS. 20 and 21 in a fully mated configuration.
Figure 21:
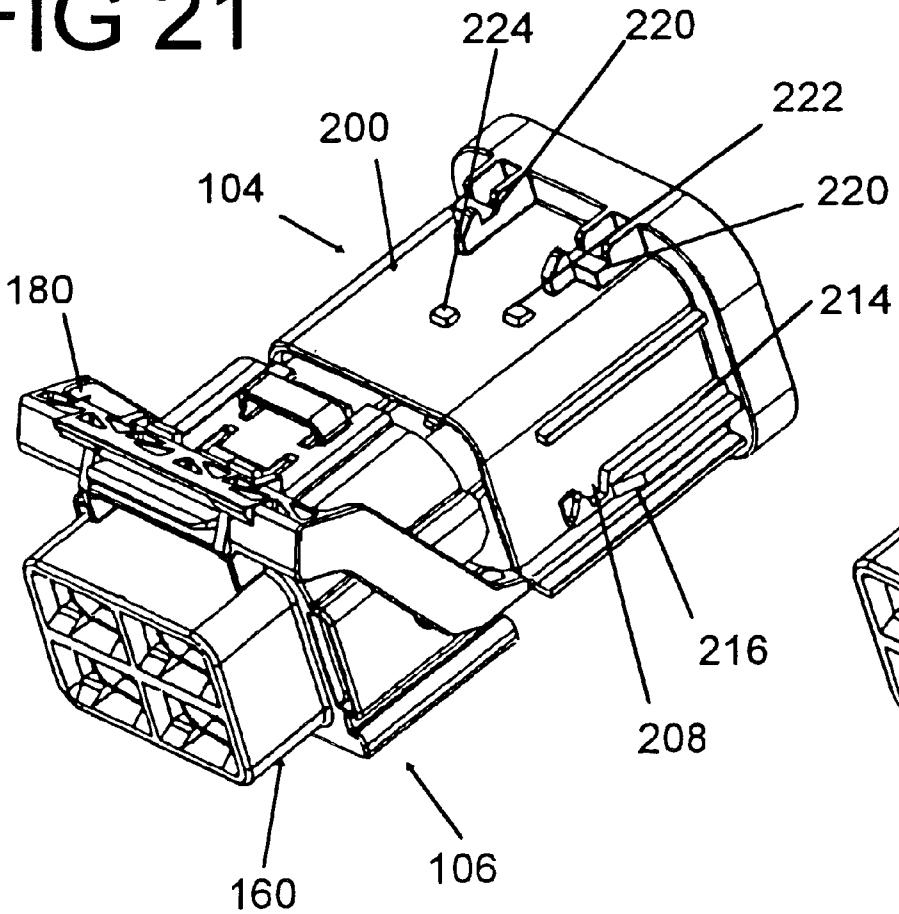
FIG. 21 is another view of the mating plug and header connectors of FIG. 20.
Figure 27:
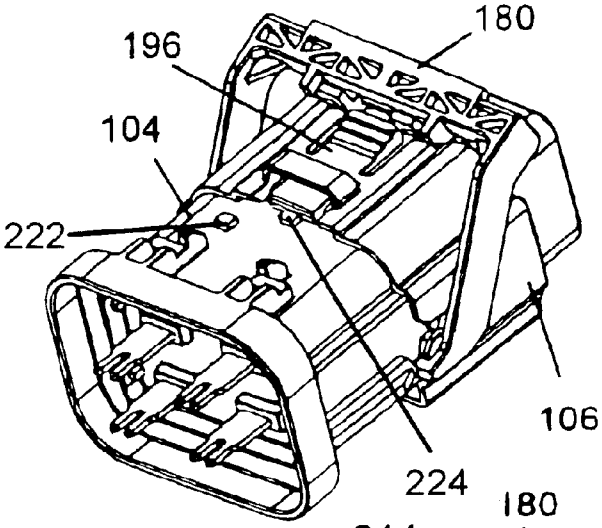
FIGS. 26–32 show the mating sequence of the two connectors of the second embodiment of this invention.

The embodiment of FIG. 20 also includes a lever 180 that functions as a mechanical assist member to overcome forces resisting mating and unmating of the two electrical connectors 104, 106. The lever 180 is mounted on the plug connector housing 160 and engages the header housing 200 so that rotation of the lever 180 moves the plug connector 106 relative to the header 200. However, as will be subsequently discussed in more detail, the lever 180 does not move the two connectors 104, 106 completely from a fully mated position to a fully unmated position, nor does it move the two connectors from a fully unmated position to a fully mated position. FIG. 21 shows the two connectors 104, 106 in a fully unmated configuration and FIG. 22 is a view of a fully mated configuration. Comparison of these two views shows that the lever 180 is rotated in a clockwise direction to fully mate the two connectors 104, 106.

FIGS. 23 and 24 show the manner in which the lever 180 can be mounted on the plug connector housing 160. The lever has two arms 182 that are joined by a central handle 184 in the form of a crosspiece extending between ends of the arms 182. Each lever actuation arm 182 includes a pivot pin 190 located on the interior of the arm, intermediate their opposite ends. These pivot pins 190 fit within sockets 170 on the sides of the plug connector housing 160. The sockets 170 are formed in a sleeve 166 that surrounds the sides of the main body 162 of the plug connector housing 160. Each socket 170 has a circular bearing surface 172 that is interrupted by a slot 174 that extends inwardly from the mating face 164 of the plug housing 160. Each arm 182 also includes a finger 194 at its distal or free end. A cam arm 192 is located on one side of each pivot pin 190. As will be subsequently discussed in greater detail, these cam arms 192 will fit within cam grooves 208 on the header housing 200 to impart relative movement between the plug connector 106 and the header 104 as the lever 180 is rotated.

The plug connector housing 160 also includes an auxiliary housing latch 196 located on the top 198 of the housing 160 shown in FIG. 23. There is an inertial detent on housing 160 that is opposite to the housing latch 196. The mechanical assist lever 180 is used to disconnect the main blade contacts 114A, B from the mating receptacle terminal 150 in the plug connector 106. The auxiliary latch 196 must be activated to disconnect the auxiliary blade contact 130 from the mating receptacle terminal 150.

The molded header housing 200 that mates with the plug connector housing 160 is shown in FIG. 25. This header housing 200 has a header shroud 202, which forms a cavity 204 in which at least one arc-less blade terminal 110, such as that shown in FIGS. 13 and 14 is located. Other terminals, typically in the form of male pins, could also be located within this cavity 204. These other conventional male pins would mate with conventional receptacles and would be used in circuits that would not carry sufficient current or electrical energy to create an arc. Alternatively, more than one arc-less blade terminal 110 incorporating this invention could be located in the header 104.

A cam follower groove 208 is located on each exterior side of this header shroud 202. Only one cam follower groove 208 is shown in FIG. 25. A mirror image cam follower groove is hidden from view on the opposite side of the view of the header housing 200 shown in FIG. 25. These cam follower grooves 208 are dimensioned to receive the cam arm 192 located on the lever 180 that is mounted on the plug housing 160. The cam arms 192 engage surfaces of these grooves as the lever 180 is rotated between first and second positions. When the lever 180 is rotated to fully mate the two connectors, each cam arm engages the surface 210 of the cam groove 208 closest to the mating end of the header. When the cam arm 192 is rotated in the opposite direction, the cam arm engages the other side 212 of the cam groove 208 to cause relative movement of the two connectors 104, 106 from a fully mated configuration to a configuration in which the shorter main contacts 114A, B are disengaged or disconnected, but the auxiliary contact 130 still engages its mating receptacle contact terminal 150. Guide rails 218 are included on the interior and exterior surfaces of the shroud 202 to insure that the mating connectors 104, 106 move parallel to a mating axis during unmating and mating. These guide rails 218 also comprise reaction surfaces, which prevent the cam arms 192 from becoming disengaged from the corresponding cam grooves 208.

Figure 28:
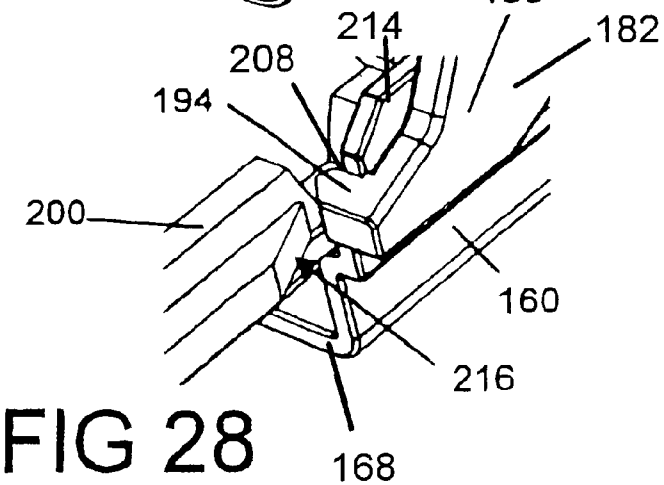
Figure 26:
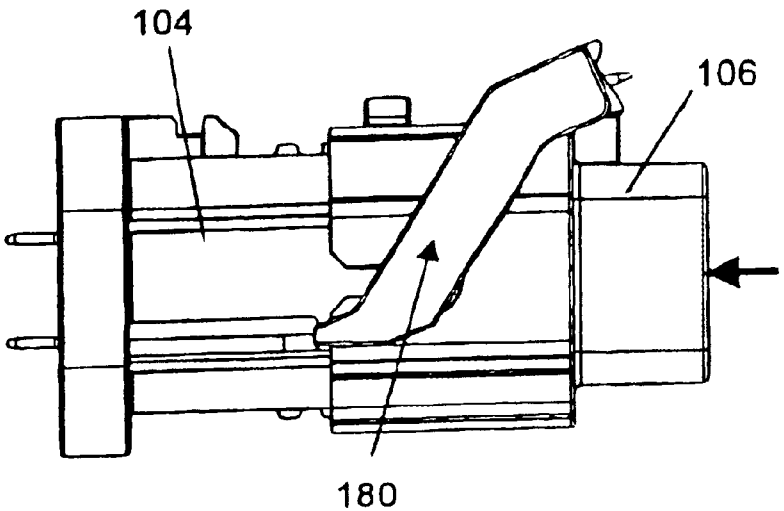
Figure 29:
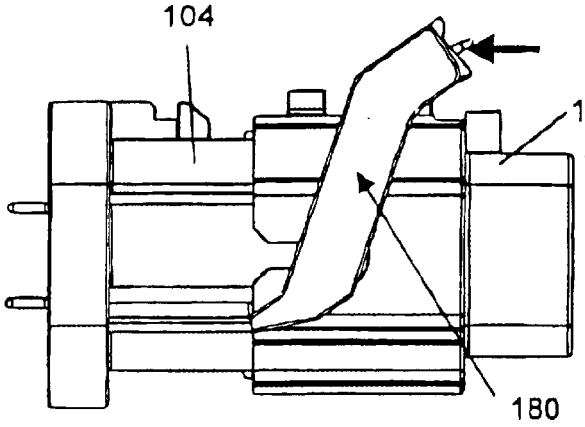
Figure 30:
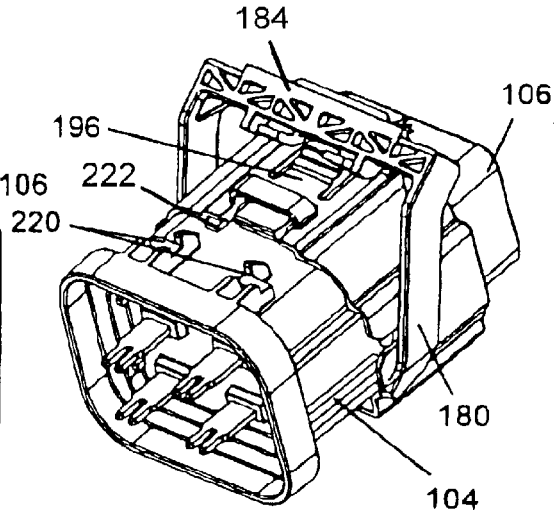

A sloping surface 216 is located adjacent to and slightly to the rear of each cam groove 208, as shown in FIG. 28. Both the cam grooves 208 and these sloping surfaces 216 are formed on a rib 214 protruding from the exterior side face of the header shroud. The sloping surface 216 extends laterally outward of the portion of the rib 214 in which the cam groove 208 is formed. These sloping surfaces 216 are located in positions so that they will engage the fingers 194 located at the distal ends of the two lever arms 182 to force each lever arm 182 outward so that the fingers 194 can clear front edges 168 of the plug connector sleeve 116 so that the lever 180 is free to move. The manner in which the lever arms 182 are unlocked, and the significance of this feature, will be subsequently discussed in greater detail.

Two latching grooves 220 are located on the top surface of the header housing 200 when viewed from the perspective of FIG. 25. These latching grooves 220 receive latching clips 186 on the lever handle 184 to lock the lever 180 in place when the connectors are fully mated. These clips 186 can be disengaged by depressing a projection 188 on the lever handle 184. The header shroud 202 also includes two detents 222, 224 projecting from the upper surface. Identical detents project from the lower surface of the header shroud. These detents 222, 224 engage opposed surfaces on the interior of the plug connector sleeve. These detents function in the same manner as those shown in U.S. patent application Ser. No. 09/929,432 filed on Aug. 14, 2001 incorporated herein by reference. The first or inner detent 222 engages a surface on the plug connector sleeve 166 to hold the connectors in fully mated configuration. A force applied to the lever 180 is sufficient to cause slight deformation of the connector housings to permit the connectors to move to a fully mated configuration. Similarly, a force applied to the lever 180 in the opposite direction overcomes the latching effect of this inner detent 222 so that the connectors 104, 106 can be moved from a fully mated configuration to an intermediate configuration in which the main contacts 12 have been disconnected, but in which the auxiliary contact 130 remains in engagement with the receptacle terminal 150. At this point the auxiliary plug connector housing latch 196 engages the second or outer detent 224, which is laterally offset relative to the first detent 222 and which is closer to the mating end of the header connector 104. Further rotation of the lever 180 cannot then disconnect the connectors because of the engagement between the auxiliary latch 196 and the second or outer detents 224. At this point an operator must press the opposite end of the auxiliary latch 196 located on the top of the plug connector housing 160. There is an inertial detent that can be overcome with increased unmating force. The top latch is the only cantilever beam that must be depressed by the user. The inertial detent on the bottom of the connector is necessary to insure that the auxiliary contact unmates or disconnects quickly and cleanly through the Auxiliary Disconnect Zone (ADZ).) The lever 180 will have rotated sufficiently to expose latch 196, but it will take some time for the operator to change hand position from the lever 180 to the top auxiliary latch 196 and depress it in order to fully unmate the connectors. This time delay will be sufficient for the $I^2R$ heating to switch the PTC conductive polymer 140 from an ON, or low resistance state, to an OFF or high resistance state. This delay will also be sufficient to allow the current flow through the auxiliary contact 130 to drop below the arcing threshold, regardless of the initial current flowing through the connector, and the trip time of the PTC conductive polymer 140, or other PTC devices. After the auxiliary latch 196 has been disengaged and the inertial feature has been overcome, then connectors 104, 106 can be fully disconnected and separated.

Figure 31:
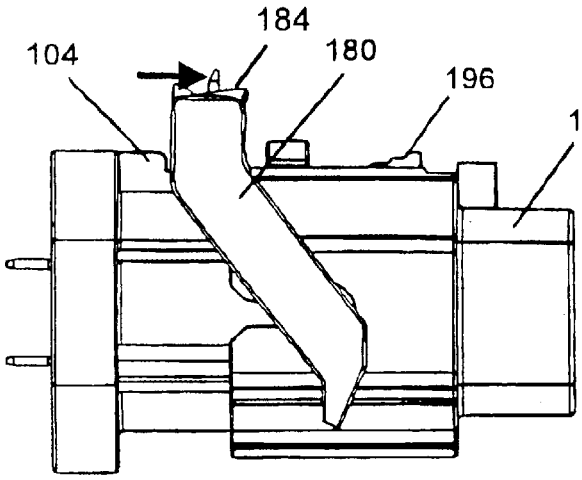
Figure 32:
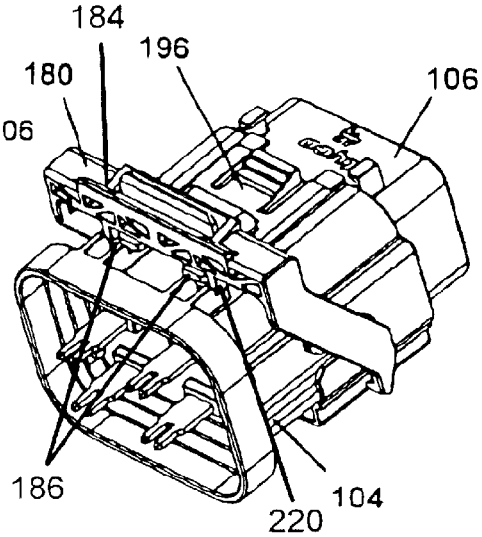

FIGS. 29–32 show the manner in which the two connectors 104, 106 are mated. FIGS. 33–37 show the unmating steps. To mate the two connectors 104, 106 it is first necessary for an operator to push the two connectors 104, 106 into partial engagement. Since the header 104 will normally be fixed to an electrical component, and may be mounted on a fixed bulkhead or panel, this step will normally require the operator to grasp the plug connector 106, which will normally be attached to wires or on the end of a wire harness. The operator will align the two connectors and then push the plug connector 106 into partial engagement with the header connector 104. There will, of course, be no functional difference if the receptacle is a bulkhead mounted configuration attached to wires. There is also no relevant difference if the receptacle is a free-hanging cable version except that both connectors must probably be grasped to accomplish the mating operation. The auxiliary latch 196 will ride up and over the detent 224. (The inertial feature located opposite to the auxiliary latch 196 must also be overcome.) The end of the auxiliary contact 130 will engage the receptacle terminal 150. If the circuit to which either terminal 110, 150 is attached is live, some current will initially flow through the auxiliary contact 130, and there will be a make spark as the auxiliary contact 130 engages the receptacle terminal 150. A make spark is benign compared to a breaking arc and will not cause significant damage. Assuming that current initially flows through the auxiliary contact 130 at this point, the PTC conductive polymer 140 will also conduct since it will be in the ON or RESET state prior to mating. If the current is high enough the PTC conductive polymer 140 will trip to the OFF condition. If the initial current is not sufficient to trip the PTC conductive polymer 140, then the PTC conductive polymer 140 will remain in the ON state. The operator will not be able to push the connector 104, 106 to their fully mated configuration because the cam profiles for the lever mechanism 180 will prevent further movement of the connector unless the lever is rotated. Just prior to engagement of the main contacts 112 with the receptacle terminal 150, the fingers 194 on lever arms 182 will engage the sloping surfaces 216 on the exterior of the header shroud 202 to force the lever arms 182 outward and free the lever arms 182 from abutting edges 168 of the plug housing sleeve 166. The lever 180 can now be rotated to its fully engaged position as shown in FIGS. 31 and 32 in which the main contacts 112 will be fully mated with the receptacle terminal 150. If the connectors 104, 106 are mated in a live state with sufficient current to have caused the PTC resistive material to switch to its OFF state prior to their engagement, a make spark will also occur as the main contacts 112 engage the receptacle terminal 150. The make spark, however, will not cause any significant damage because of its benign nature compared to a breaking arc. In any event, once there is a low resistance path established between the main contact blade sections 114A, B and the receptacle terminal 150, only a small amount of current will be allowed to flow through the auxiliary contact 130 and the PTC conductive polymer 140. If the PTC conductive polymer 140 had been in the OFF state, then connection of the main contacts 114A, B to the receptacle terminal 150 would sufficiently reduce the current through the PTC conductive polymer 140 to allow the PTC conductive polymer 140 to cool and reset to an ON state. The PTC conductive polymer will then be able to protect against an arc when unmating of the connectors 104, 106 breaks a live circuit. This cooling and recovery to the low resistance state occurs very quickly, on the order of seconds or less in typical applicable devices.

Figure 33:
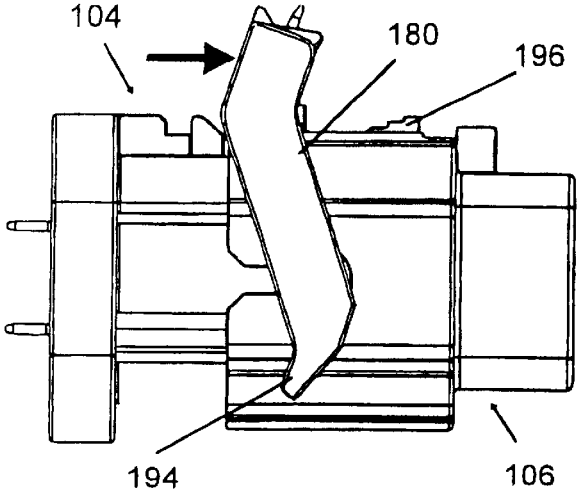
FIGS. 33–37 show the unmating sequence for the two connectors of the second embodiment.
Figure 34:
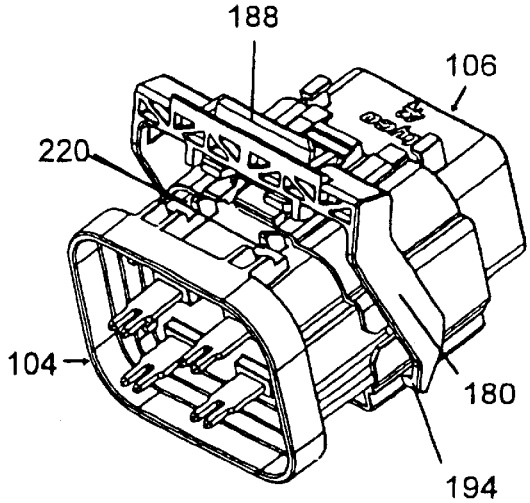
Figure 35:
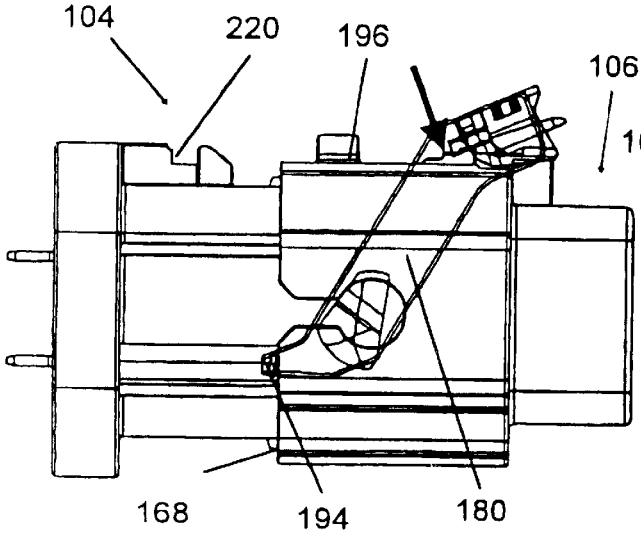
Figure 36:
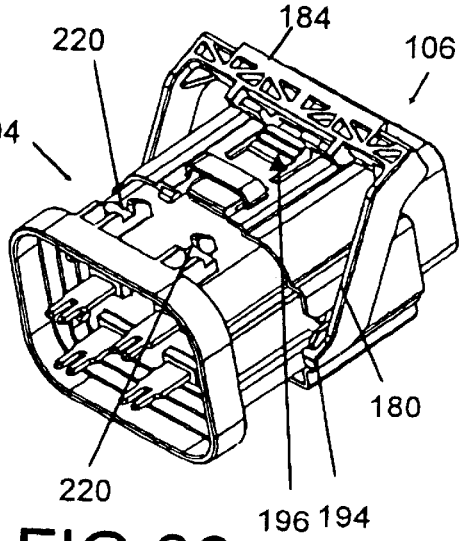
Figure 37:
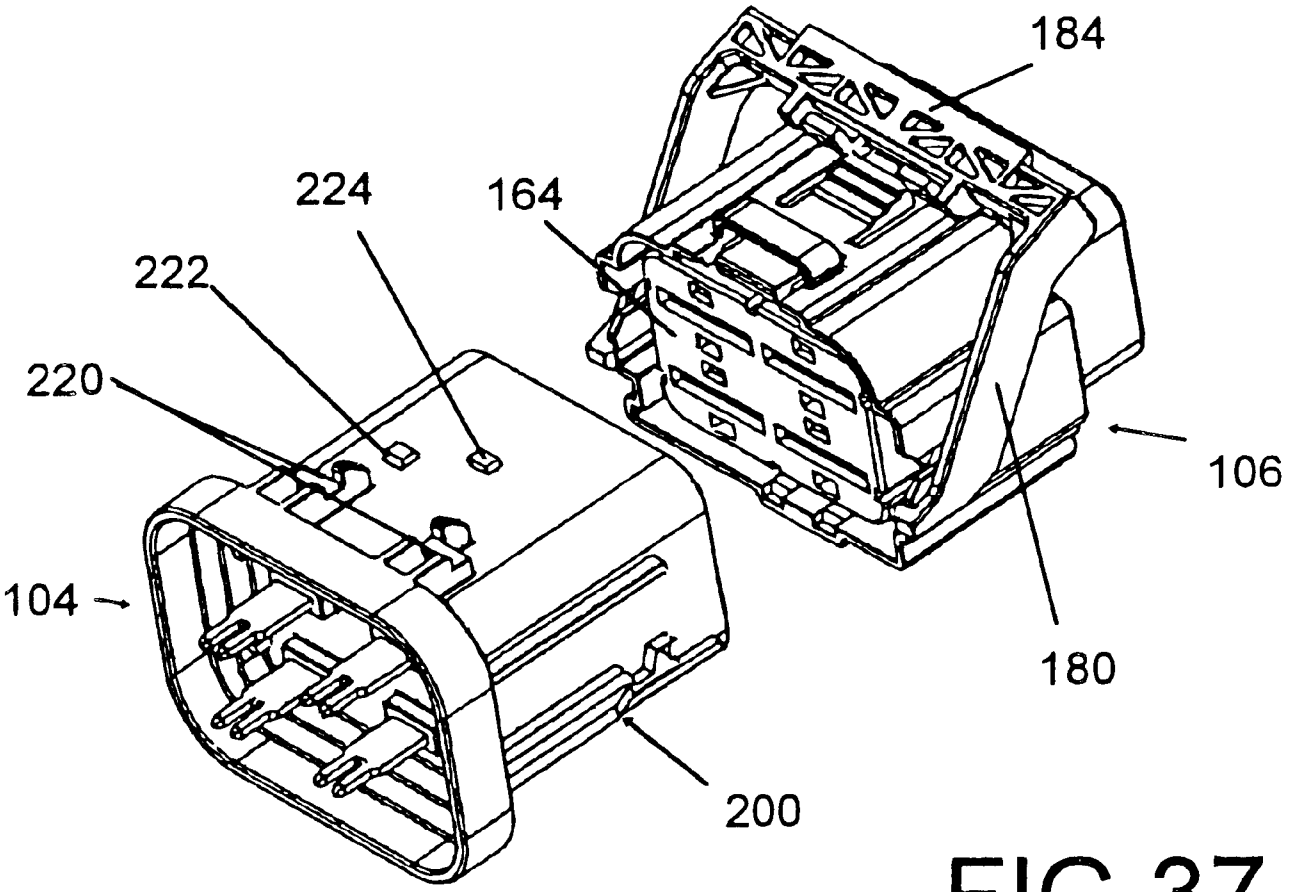

The first step in the unmating procedure is to depress the release projection 184 to permit rotation of the mechanical assist lever 180. The arrow in FIG. 31 shows the direction in which a force is applied to this release projection. After the release projection is disengaged, the lever 180 can be rotated in a clockwise direction as shown in FIG. 33. Movement of the lever 180 from the position shown in FIG. 31 to the position shown in FIG. 33 and finally to the position shown in FIG. 35 will disengage the main contact 112 from the receptacle terminal 150. Referring to FIG. 1, this will shift the main contact blade sections 114A, B from Stage 0 through the Main Disconnect Zone (MDZ) to Stage 2. The inner detent 222 on the header housing 200 and a corresponding detent or raised surface on the interior of the plug connector sleeve 166 will also prevent the two connectors 104, 106 from staying in the MDZ where the contacts either remain in contact, or experience intermittent touching which could establish an arc between the main contact 112 and the receptacle terminal 150. There is another detent for the main contact that is a mirror image of detent 222 located on the bottom of the header. The unmentioned detent is on the opposite side and shifted off center to distribute the load evenly. This detent is important because one detent would create instability. If this time is prolonged the PTC conductive polymer 140 could switch to the OFF state and permit an arc to be developed. The shape of these detents 222 will force the connectors away from the MDZ. Once the lever 180 has been moved to the position shown in FIG. 36, the auxiliary latch 196 will be exposed, and the operator will be able to actuate that latch. This auxiliary latch 196 must be depressed so that it can clear the second detent 224, and an inertial detent for the auxiliary contacts that is located on the opposite side as the latch, located closer to the mating end of the header housing 200. The time that it would take an operator to disengage the auxiliary latch 196, after first rotating the lever 180, will be sufficient for the current passing through the PTC conductive polymer 140 to be reduced to a level where an arc will not be generated when the auxiliary contact 130 is disconnected. In other words, the PTC Opening Zone will last long enough for the PTC to open regardless of the current flowing through the connector when unmating begins. The current will be low enough so that a damaging arc will not be generated as the auxiliary contact 130 moves through the ADZ (auxiliary disconnect zone). After the connectors have moved through these states, the plug connector 106 will be completely unmated and separated from the header as shown in FIG. 37.

FIG. 38 shows the damage that can result from arcing for a conventional contact that has been disconnected one time with a purely resistive load at 59 volts, 60 amperes without the use of the PTC resistor of the instant invention. Note the damage to the spring members in the mating connector. FIG. 39 shows a similar contact that has been disconnected fifty times with a purely resistive load at 59 volts, 60 amperes using a PTC in accordance with this invention. Both mating contacts are undamaged. The auxiliary contact in the protected version is also undamaged since there was only leakage current flowing through the auxiliary when it separated from the mating contact. Comparison of FIGS. 38 and 39 will show that even though the PTC resistor is attached to the male contact, protection is also afforded to the female contact. It should be understood, however, that the PTC resistor and the auxiliary contact can be employed on the receptacle side and that the main and auxiliary contacts need not be male members.

Figure 40:
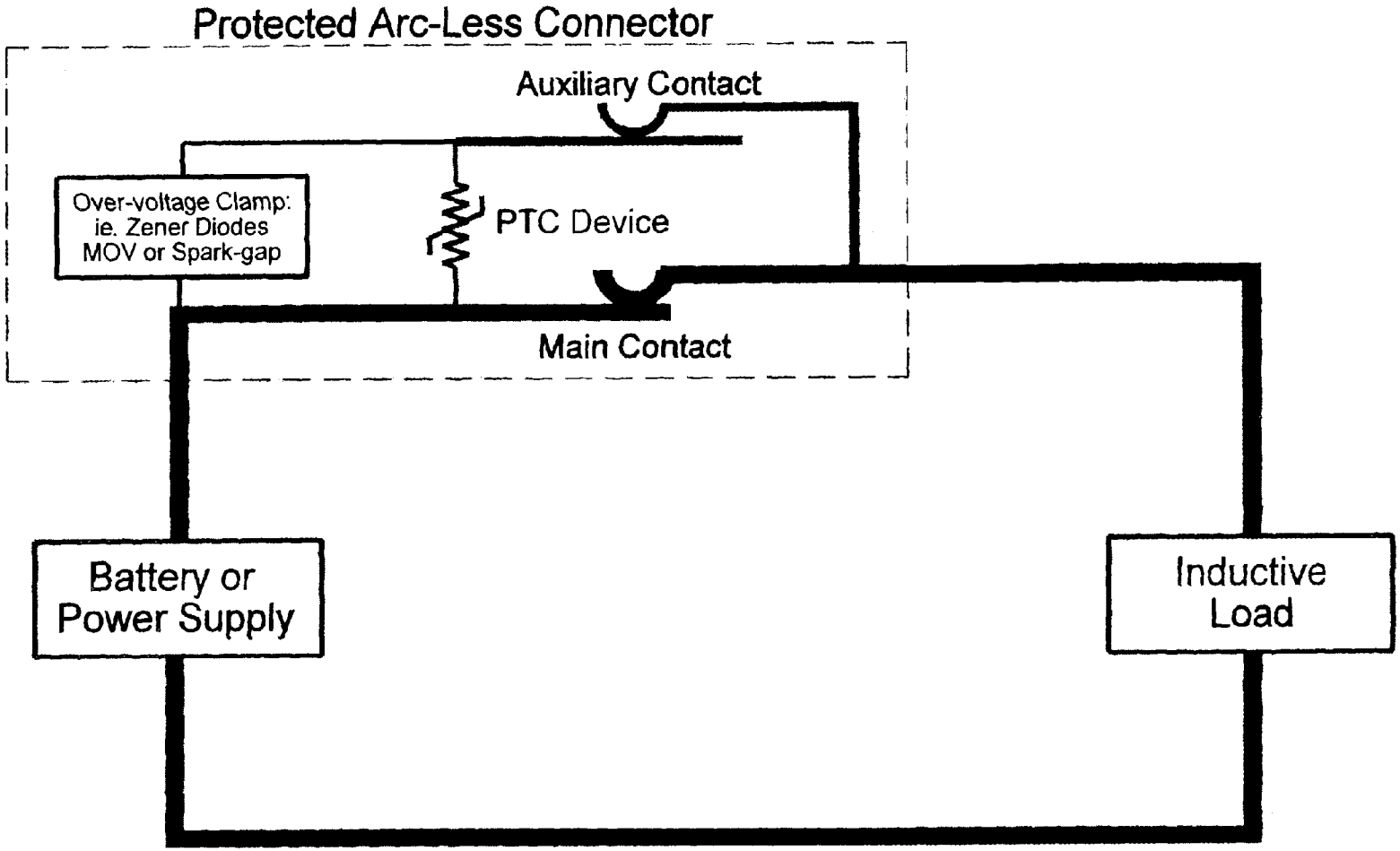
FIG. 40 is a schematic representation of a means to protect an electrical system from the over-voltage effects of an inductive load.
Figure 41:
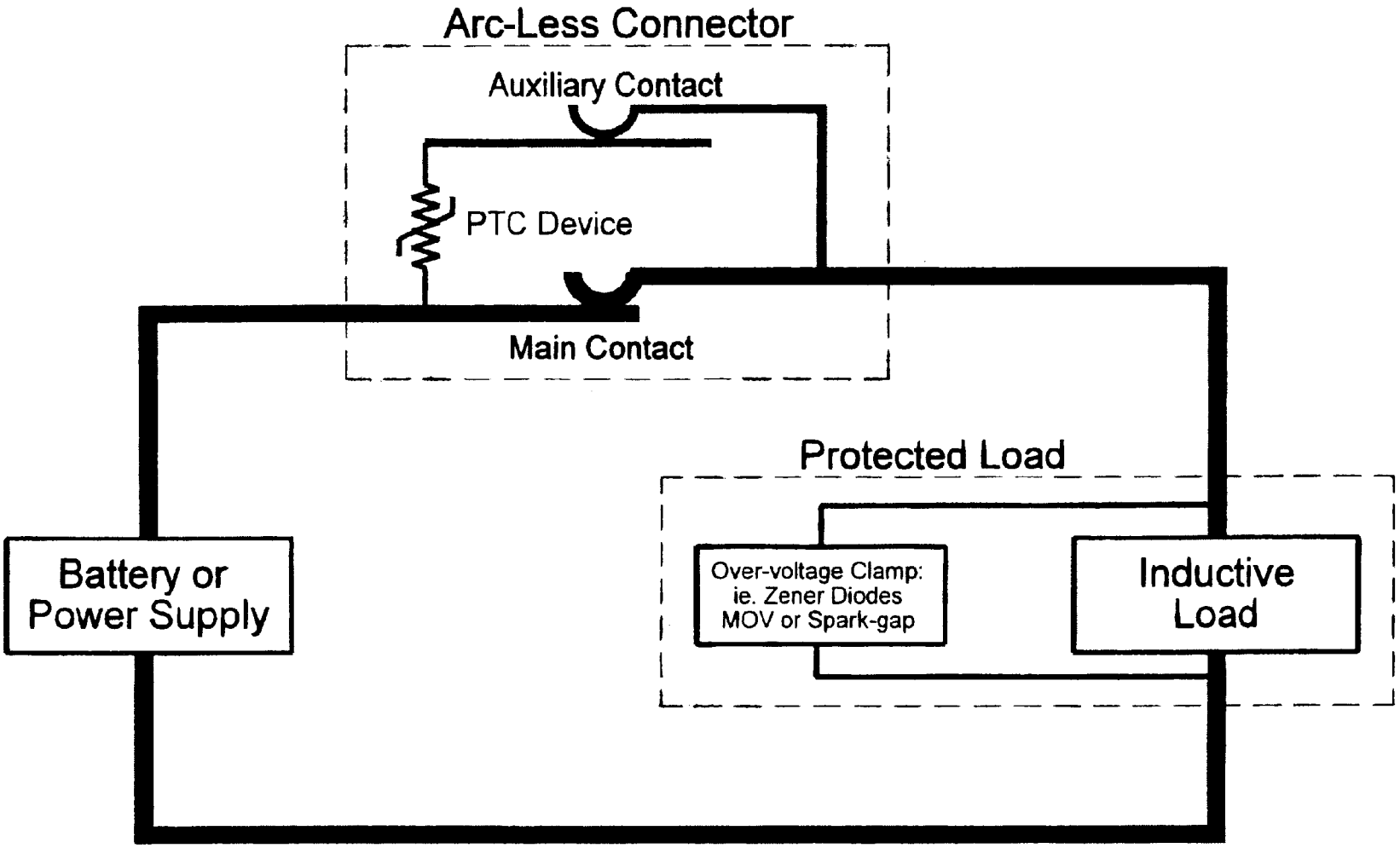
FIG. 41 is a schematic representation of a second means to protect an electrical system from the over voltage effects of an inductive load.

FIGS. 38 and 39 show the effects of the conductive polymer PTC device to prevent arcing damage when a connector assembly is used with a purely resistive load. Inductive loads can be expected to cause over-voltage spikes when the connectors are disconnected while high currents are flowing. If the PTC device can withstand those voltage spikes, the arc protection will work exactly as previously described. If the PTC device cannot withstand the voltage spikes, then it can be destroyed unless it is protected from those over-voltages by utilizing an over-voltage protection device such as an MOV, zener diodes or spark-gaps. Alternatively, the inductive load can have the over-voltage protection devices across it and there will again be no destructive over-voltage exposure for the PTC device. FIGS. 40 and 41 shows the manner in which a surge suppressor can be connected in parallel with the PTC device in a connector assembly according to this invention as well as in parallel with an inductive load to compensate for these voltage spikes.

Separation velocity is controlled in each of the representative embodiments of this invention by employing a two step unmating procedure that results in a sufficient time delay to allow the conductive polymer PTC device to turn OFF before the auxiliary contact is disengaged. Means are also provided in the preferred embodiment that will insure that the main contacts are quickly disconnected before the PTC member is able to switch to the OFF condition. The representative means discussed herein are not the only means of separation velocity control that can be employed. The unmating velocity of a manually operated electrical connector can be controlled in different ways. Also, if the load current range is limited, meaning that there is a minimum current that can flow, which is a significant percentage of the maximum current, the delay caused by the additional length of the auxiliary contact can be sufficient, causing a distinct 2-step disengagement to be unnecessary.

Figure 42A:
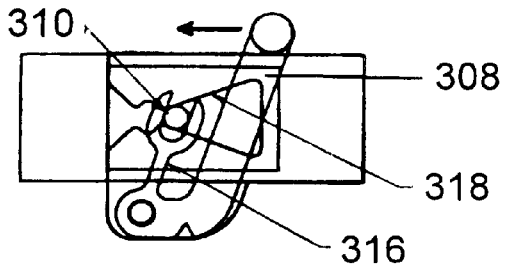
FIGS. 42A–42D show and alternate embodiment in which a connector assembly employs a lever that provides rapid unidirectional movement through the contact disconnect zones and the time delay between them with a single lever.
Figure 42B:
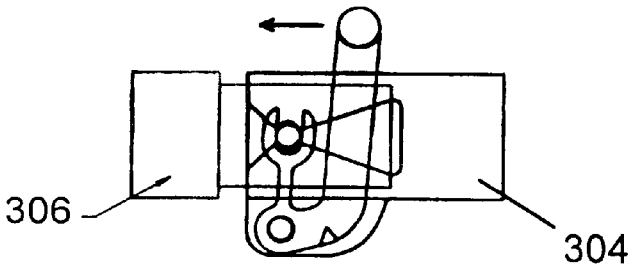
Figure 42C:
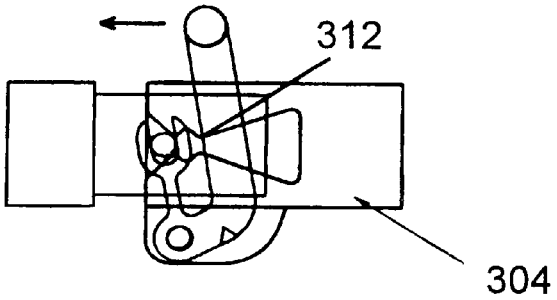
Figure 42D:
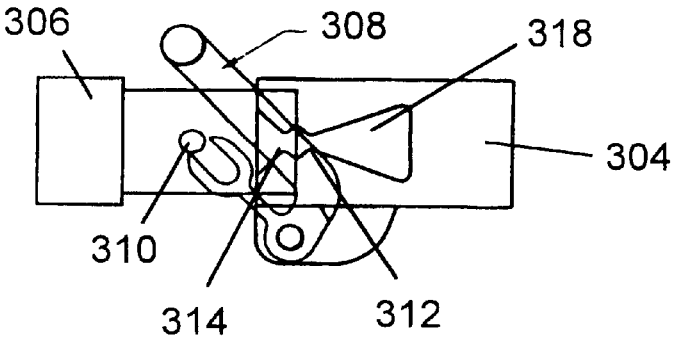

Other approaches exist to cause some resistance that the human operator must overcome when disconnecting a mating connector. One such example is shown in FIGS. 42A–42D, which shows a receptacle connector 304 and a mating plug connector 306 which includes a means for providing rapid unidirectional movement through the contact disconnect zones and the time delay between them with a single lever. This alternative lever configuration can provide unidirectional high velocity through the MDZ and the ADZ, while also providing a time delay between those zones without an additional latch. The high velocity is generated as the loaded cantilever beam 316 on the lever 308 pushes the plug pin 310 through the receptacle housing detents 312, 314 in a housing channel 318 as shown in FIGS. 42A and 42C. As shown in FIG. 42B, the time delay is caused when the cantilever beam 316 on the lever 308 relaxes after pushing the plug pin 310 through the first receptacle housing detent 312 and then is re-flexed or reloaded by continuing motion of the lever 308 until it can push the plug pin 310 through the second receptacle housing detent 314.

In other versions, a detent, or spring release feature, would also preload the human force to the level necessary to guarantee a sufficient velocity over the critical separation zones. Pistons, or dashpot devices, can provide controlled resistance that can slow velocity and additional latching mechanisms or levers can force momentary stops between the separation of the main and auxiliary contacts if necessary. Other means would also be apparent to one of ordinary skill in the art.

This invention is also not limited to a conductive polymer PTC device. Other positive temperature coefficient resistance devices exist that could be substituted for the conductive polymer PTC devices or materials that are used in the preferred embodiments discussed herein. Metallic PTC devices are know to exist which could be employed in alternate embodiments that employ all of the basic elements of this invention. Other PT materials such as doped-$BaTiO_3$ might also be employed, although the expense of these various alternatives may prevent them from comprising an acceptable commercial alternative to the use of conductive polymer PTC devices and materials. Other alternative embodiments would be apparent to one of ordinary skill in the art. Therefore the invention, described herein in terms of representative preferred embodiment, is not limited to those representative embodiments, but is defined by the following claims.

We claim:

1. An electrical connector matable to and separable from a separate mating electrical connector, the electrical connector including first and second contacts and a variable resistance member connecting the first and second contacts, the variable resistance member providing a shunt so that arcing does not occur when the first contact is disconnected from a mating terminal in the separate mating electrical connector, wherein the variable resistance member comprises a positive temperature coefficient resistance member.

2. The electrical connector of claim 1 wherein electrical resistance in the variable resistance member increases in response to increasing current to reduce the flow of current through the second contact before the second contact is disconnected from a mating terminal in the mating connector so that arcing does not occur when the second contact is disconnected.

3. The electrical connector of claim 2 wherein an increase in resistance in the variable resistance member lags an increase in current.

4. The electrical connector of claim 1 wherein the variable resistance member comprises a conductive polymer member with conductive particles immersed in a nonconductive polymer, increased $I^2R$ heating causing the nonconductive polymer to expand to disrupt conductive paths formed by interconnected conductive particles.

5. The electrical connector of claim 1 wherein the second contact is longer than the first contact so that the first contact is disconnected before the second contact as the electrical connector is unmated from the mating electrical connector.

6. The electrical connector of claim 1 including a latch that must be disengaged after the first contact is disconnected and before the second contact can be disconnected.

7. The electrical connector of claim 6 wherein disengagement of the latch provides sufficient time for the resistance of the variable resistance member to increase to a value such that the current in the second contact is below an arcing threshold before the latch can be disengaged.

8. The electrical connector of claim 7 wherein the connector includes first and second latches, disconnection of the first latch being required before disconnection of the first contact and disengagement of the second latch being required before disconnection of the second contact.

9. The electrical connector of claim 7 wherein movement of a lever on the connector moves the connector to disconnect the first contact.

10. The electrical connector of claim 9 wherein the latch can only be disengaged after movement of the lever to disconnect the first contact.

11. An electrical connector matable to and separable from a separate mating electrical connector, the electrical connector comprising;

a main contact member;

an auxiliary contact member;

a variable resistive member connected between the main contact member and the auxiliary contact member, and disconnect means for discontinuously disconnecting first the main contact member and then the auxiliary contact member from terminal means in the mating electrical connector to reduce arcing when separation of the electrical connector from the mating electrical connector disconnects current through the electrical connector.

12. The electrical connector of claim 11 wherein current through the main contact member exceeds current through the auxiliary contact member prior to disconnection of the main contact member.

13. An electrical connector matable to and separable from a separate mating electrical connector, the electrical connector comprising:

a main contact terminal including means for connecting the main contact terminal to an electrical conductor;

an auxiliary contact terminal; and a resistive member connecting the auxiliary contact terminal to the main contact terminal, such that current passing through the auxiliary contact terminal also passes through the main contact terminal and the resistive member, the resistive member being characterized in that an increase in electrical resistance of the resistive member lags an inrush current through the resistive member, so that the resistive member carries a current approximately equal to the inrush current for a period of time referred to as a trip time, wherein the resistive member comprises a positive temperature coefficient resistive member;

the electrical connector being configured to disconnect the main contact terminal from a mating electrical terminal in the separate mating electrical connector prior to disconnection of the auxiliary contact terminal from a mating electrical terminal in the mating electrical connector, the time to disconnect the main contact terminal by a distance sufficient such that an electrical arc cannot be sustained comprising a disconnect time, the disconnect time being less than the trip time so that arcing is prevented upon disconnection of the main contact terminal.

14. The electrical connector of claim 13 wherein the main contact terminal carries a larger current when connected to the mating electrical connector than the auxiliary contact terminal carries when both the main and the auxiliary contact terminals are connected to the mating electrical connector.

15. The electrical connector of claim 13 wherein the auxiliary terminal is disconnected from a mating electrical terminal after a finite time interval from the disconnecting of the main contact terminal, the finite time interval being long enough for resistance in the resistive member to increase sufficiently to reduce the current through the auxiliary terminal below an arcing threshold, so that arcing does not occur upon disconnection of the auxiliary contact terminal.

16. The electrical connector of claim 13 wherein the electrical resistance of the resistive member is greater than the electrical resistance of the main contact terminal so long as the main contact terminal remains connected to the mating electrical terminal.

17. An electrical connector matable to and separable from a separate mating electrical connector, the electrical connector comprising:

a main contact terminal;

an auxiliary contact terminal;

a switch comprising a positive temperature coefficient resistance member connected between the main contact terminal and the auxiliary contact terminal, the switch being characterized by a finite trip time to switch from a first relatively low resistance state to a second relatively higher resistance state;

the electrical connector being configured so that the main contact terminal is separable from a mating terminal in the separate mating electrical connector in a disconnect time that is less than the trip time to reduce arcing when the main contact terminal is disconnected when current flows through the electrical connector and the separate mating electrical connector, disconnection of the auxiliary contact being delayed relative to disconnection of the main contact by a sufficient time so that both the main contact and the auxiliary contact can be disconnected without arcing.

18. The electrical connector of claim 17 wherein the main contact terminal has a resistance that is less than the relatively low resistance state of the switch.

19. The electrical connector of claim 17 wherein the switch exhibits a nonlinear increase in resistance relative to current over a specified temperature range.

20. An electrical connector that can be disconnected, without damage due to arcing, from a separable mating electrical connector while carrying electrical energy above an arcing threshold, the electrical connector comprising:

a main contact matable with and unmatable from a mating contact in the mating electrical connector;

at least one auxiliary contact;

a positive temperature coefficient resistor between the main contact and the auxiliary contact;

the main contact being separable from the mating contact before the auxiliary contact is disconnected from a circuit including the mating contact in the mating connector so that the resistance in the positive temperature coefficient resistor increases after disconnection of the main contact from the mating contact and prior to disconnection of the auxiliary contact from the circuit so that both the main contact and the auxiliary contact can be disconnected without arcing.

21. The electrical connector of claim 20 wherein the auxiliary contact is matable with and unmatable from the same mating contact to which the main contact is matable.

22. The electrical connector of claim 20 wherein the main contact is shorter than the auxiliary contact.

23. The electrical connector of claim 20 wherein the positive temperature coefficient resistor comprises a separate component having leads connected to both the main and the auxiliary contact.

24. The electrical connector of claim 20 wherein the positive temperature coefficient resistor is bonded between the main contact and the auxiliary contact.

25. The electrical connector of claim 24 wherein the positive temperature coefficient resistor comprises a molded member secured on one side to a central section of the main contact and secured on an opposite side to the auxiliary contact.

26. The electrical connector of claim 20 wherein the main contact and the auxiliary contact each comprise blades.

27. The electrical connector of claim 20 wherein the positive temperature coefficient resistor comprises a conductive polymer.

28. The electrical connector of claim 27 wherein the conductive polymer comprises a polymer with a conductive particulate filler dispersed in the polymer.

29. The electrical connector of claim 20 wherein the main contact comprises a lower resistance electrical path than an electrical path through the auxiliary contact and the positive temperature coefficient resistor so that a rapid increase in current occurs through the positive temperature coefficient resistor and the auxiliary contact after the main contact is separated from the mating contact.

30. The electrical connector of claim 29 wherein the resistance of the positive temperature coefficient resistor increases sufficiently rapidly between separation of the main contact and disconnection of the auxiliary contact so that the electrical energy flowing through the auxiliary contact is reduced below the arcing threshold after separation of the main contact and before disconnection of the auxiliary contact.

31. The electrical connector of claim 20 wherein the positive temperature coefficient resistor resets to a low resistance state after the electrical connector is unmated from the mating electrical connector.

32. The electrical connector of claim 20 wherein the current carrying capacity of the main contact is greater than the current carrying capacity of the auxiliary contact.

33. The electrical connector of claim 20 wherein the electrical connector includes a housing matable with a mating housing in the mating electrical connector, the two housings limiting the minimum time between separation of the main contact from the mating contact and disconnection of the auxiliary contact to a time sufficient for the electrical energy flowing through the auxiliary contact to fall below the arcing threshold.

34. The electrical connector of claim 33 wherein the housing comprises means for assuring that unmating of the connectors, while the contacts are in a position susceptible to arcing is unidirectional.

35. An electrical connector matable to and unmatable from a separate mating connector, the electrical connector comprising:

a main contact;

an auxiliary contact;

a variable resistance positive temperature coefficient member between the main contact and the auxiliary contact;

a first latch disengagable from the mating connector, to disconnect the main contact from mating terminal means in the mating connector;

a second latch disengagable from the mating connector after the main contact has been disconnected from the mating terminal means, the auxiliary contact being disconnectable from a mating terminal means in the mating electrical connector upon disengagement of the second latch.

36. The electrical connector of claim 35 wherein the variable resistance positive coefficient member comprises means for first shunting current to the auxiliary contact after the main contact has been disconnected and means for increasing the resistance to current through the auxiliary contact before the auxiliary contact is disconnected.

37. The electrical connector of claim 35 wherein the electrical connector can be unmated from the mating connector only by first disengaging the first latch and subsequently disengaging the second latch.

38. An electrical connector disconnectable from a separate mating electrical connector without arcing, the electrical connector comprising:

main contact means and auxiliary contact means, each matable with and unmatable from mating terminal means in the mating electrical connector as the electrical connector is separated from the mating electrical connector;

resistive means comprising positive temperature coefficient resistive means between the main contact means and the auxiliary contact means, the main contact means comprising a lower resistance path than a path through the resistive means and the auxiliary contact means;

the electrical connector being configured so that, when the electrical connector is unmated and separated from the mating electrical connector, the main contact means is disconnected from the mating terminal means in the mating electrical connector before disconnection of the auxiliary contact means and the mating terminal means so that a current path through the auxiliary contact means and the resistive means to the mating terminal means remains intact after disconnection of the main contact means from the mating terminal means;

the resistance through the resistive means and the auxiliary contact means being greater when the auxiliary contact means is disconnected from the mating terminal means than when the main contact means is disconnected from the mating terminal means so that arcing does not occur when the main contact means and the auxiliary contact means are sequentially disconnected from the mating terminal means.

39. The electrical connector of claim 38 wherein the resistive means comprises a variable resistance member.

40. An arc avoidance electrical connector disconnectable and separable from a mating electrical connector under load, the electrical connector including:

a main contact disconnectable from a mating terminal in the mating electrical connector as the mating electrical connector is unmated and separated from the electrical connector;

shunting means for shunting sufficient current through an alternate path to the mating electrical connector as the main contact is disconnected from the mating terminal so that arcing does not occur as the main contact is disconnected from the mating terminal, wherein the shunting means includes a positive temperature coefficient resistive member.

41. An electrical connector matable to and separable from a separate mating electrical connector, the electrical connector comprising;

a main contact member;

an auxiliary contact member;

a variable resistive member connected between the main contact member and the auxiliary contact member, wherein the variable resistive member comprises a positive temperature coefficient resistive member and disconnect means for disconnecting first the main contact member and then the auxiliary contact member in two stages to reduce arcing when disconnection of the electrical connector disconnects current through the electrical connector.

* * * * *